US010399090B2

(12) United States Patent
Bingham et al.

(10) Patent No.: US 10,399,090 B2
(45) Date of Patent: Sep. 3, 2019

(54) APPARATUS FOR A SCREEN PULSE SYSTEM

(71) Applicant: M-I L.L.C., Houston, TX (US)

(72) Inventors: Richard Bingham, Katy, TX (US); Calvin Carter, Houston, TX (US); Benjamin L. Holton, Covington, KY (US); John H. Fedders, Florence, KY (US); Mitchell A. Landwehr, Villa Hills, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/735,605

(22) PCT Filed: Jun. 13, 2016

(86) PCT No.: PCT/US2016/037233

§ 371 (c)(1),
(2) Date: Dec. 11, 2017

(87) PCT Pub. No.: WO2016/201433

PCT Pub. Date: Dec. 15, 2016

(65) Prior Publication Data

US 2018/0311679 A1 Nov. 1, 2018

Related U.S. Application Data

(60) Provisional application No. 62/175,022, filed on Jun. 12, 2015.

(51) Int. Cl.

| | |
|---|---|
| ***B03B 11/00*** | (2006.01) |
| ***B03B 5/06*** | (2006.01) |
| ***B07B 13/16*** | (2006.01) |

(52) U.S. Cl.

CPC ..... *B03B 5/06* (2013.01); *B03B 11/00* (2013.01); *B07B 13/16* (2013.01); *B07B 2230/01* (2013.01)

(58) Field of Classification Search

CPC .. B03B 5/06; B03B 5/24; B03B 11/00; B07B 1/46; B07B 13/16; B07B 2201/04; B07B 2230/01; F16B 2200/40; F16B 2200/403

See application file for complete search history.

(56) References Cited

U.S. PATENT DOCUMENTS 2,767,609 A * 10/1956 Cousino ..... F16B 37/046 24/290
2,785,802 A * 3/1957 Symons ..... B07B 1/38 209/270

(Continued)

FOREIGN PATENT DOCUMENTS

WO 2012/013584 A1 2/2012

OTHER PUBLICATIONS

International Search Report and Written Opinion for the equivalent International patent application PCT/US2016/037233 dated Sep. 22, 2016.

(Continued)

*Primary Examiner* — Joseph C Rodriguez
(74) *Attorney, Agent, or Firm* — Jeffrey D. Frantz

(57) ABSTRACT

An apparatus includes a manifold plate-like structure having two end regions and an opening located in the recessed region configured to allow fluid flow therethrough and a clamping device. The clamping device includes a first clamping block and a first mechanical fastener to couple the first clamping block and the manifold. The apparatus also includes a vibratory separator including a basket having support structure therein, the manifold coupled to the support structure with a clamping device. A pan is disposed above the manifold and coupled to the manifold and a screen is disposed on the pan. A pressure differential device is coupled to the manifold and configured to provide a pressure differential across the screen. A method includes coupling the manifold to the support structure, disposing the pan on the support structure, and coupling the pan to the manifold.

11 Claims, 24 Drawing Sheets

(56) References Cited

U.S. PATENT DOCUMENTS

| | | | | |
|---|---|---|---|---|
| 4,410,298 | A * | 10/1983 | Kowalski | F16B 37/046 411/104 |
| 5,462,673 | A * | 10/1995 | Piers | B01D 33/0376 209/320 |
| 5,655,865 | A * | 8/1997 | Plank | E04D 3/08 411/85 |
| 6,530,482 | B1 * | 3/2003 | Wiseman | B01D 33/0346 209/253 |
| 7,703,612 | B2 * | 4/2010 | Browne | B01D 21/283 209/311 |
| 7,909,170 | B2 * | 3/2011 | Jones | B07B 1/42 209/17 |
| 8,613,360 | B2 * | 12/2013 | Carr | E21B 21/065 209/591 |
| 9,074,440 | B2 * | 7/2015 | Carr | E21B 21/065 |
| 9,127,628 | B2 * | 9/2015 | Egawa | F02M 35/10085 |
| 9,359,840 | B2 * | 6/2016 | Pomerleau | E21B 21/065 |
| 9,829,121 | B2 * | 11/2017 | Raye | F16L 5/14 |
| 2011/0280682 | A1 | 11/2011 | Egawa | |
| 2013/0074360 | A1 | 3/2013 | Pomerleau | |
| 2014/0319828 | A1 | 10/2014 | Singh et al. | |
| 2015/0048037 | A1 * | 2/2015 | Frazier | B07B 1/28 210/808 |

OTHER PUBLICATIONS

International Report on Patentability for the equivalent International patent application PCT/US2016/037233 dated Dec. 21, 2017.

* cited by examiner

APPARATUS FOR A SCREEN PULSE SYSTEM

BACKGROUND

Vibratory separators are used to separate solid particulates of different sizes and/or to separate solid particulate from fluids. Various industries use vibratory separators for filtering materials, for example, the oil and gas industry, the food processing industry, the pharmaceutical industry, and the agriculture industry. A vibratory separator is a vibrating sieve-like table upon which solids-laden fluid is deposited and through which clean fluid emerges. The vibratory separator may be a table with a generally perforated filter screen bottom. Fluid is deposited at the feed end of the vibratory separator. As the fluid travels down the length of the vibrating table, the fluid falls through the perforations to a reservoir below, leaving the solid particulate material behind. The vibrating action of the vibratory separator table conveys solid particles left behind to a discharge end of the separator table.

To facilitate or improve the rate and efficiency at which a separator removes liquids from solids, a pressure differential may be developed or applied across a screen disposed in the separator. The pressure differential may be applied by a pressure differential device internal or external to the separator that applies a pressure differential across the screen to pull both liquids and vapor or air through the screen. For example, the pressure differential device may be a vacuum generating device

DETAILED DESCRIPTION

Embodiments disclosed herein relate to an apparatus and method for securing a component in a vibratory separator. More specifically, embodiments disclosed herein relate to an apparatus and method for coupling a pressure differential device to a vibratory separator. In accordance with embodiments disclosed herein, a manifold is secured in a basket of a vibratory separator to fluidly couple a pressure differential device to the vibratory separator to provide a pressure differential across a screen of the vibratory separator. In some embodiments, the pressure differential device may be internal to the vibratory separator, while in other embodiments, the pressure differential device may be external to the vibratory separator. In some embodiments, a flowline may be coupled between the pressure differential device and the manifold. The manifold includes structure to couple the flowline thereto so that a pressure differential may be provided across a screen of a vibratory separator. In other embodiments, the flowline may be coupled to the pressure differential device and coupled to a hose assembly, wherein the hose assembly is coupled to the manifold. The manifold includes structure to couple the hose assembly thereto so that a pressure differential created proximate the flowline-hose assembly coupling may be provided across a screen of a vibratory separator.

Figure 1:
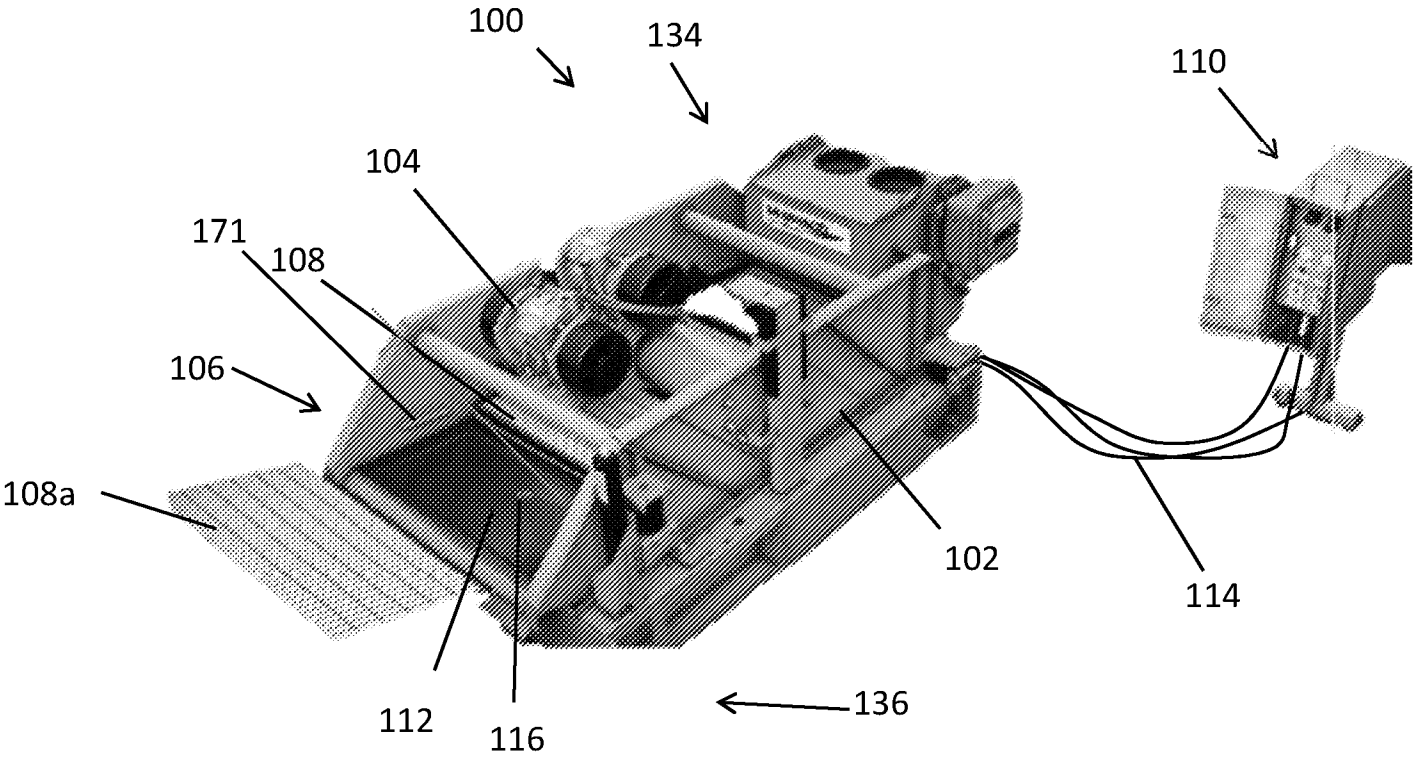
FIG. 1 is a perspective view of a vibratory separator in accordance with embodiments disclosed herein.

Vibratory separators may be used in various industries such as the food industry, cleaning industry, oil and gas industry, waste water treatment, and others. A vibratory separator may include a single deck, two decks, three decks, or more. Each deck may include one, two, or more screens. As shown in FIG. 1, for example, a vibratory separator 100 includes a basket 102, one or more motors 104 for imparting vibratory motion to the basket 102, and at least one deck 106 having at least one screen 108. Each screen 108 may include a screen frame defining a plurality of openings or slots and a screen mesh disposed thereon for separating particulate matter larger than a size of openings or perforations of the screen mesh. A vibratory separator may also include a pressure differential system including equipment for providing a pressure differential across one or more of the screens 108. The pressure differential system may include a pressure differential generating device (also referred to herein as a pressure differential device), a pan, tray, or sump located below a screen across which the pressure differential is provided, and a flowline to fluidly couple the pressure differential device and the pan. As described in more detail below, the pressure differential system may also include a manifold coupled to the basket of a vibratory separator to which the pan may be coupled, thereby providing support and structural rigidity to the pan. The pressure differential device is fluidly coupled to the manifold, and therefore, the pan, so as to provide a pressure differential across the screen.

The pressure differential device may include a timer box that supplies air to a device, such as an air eductor or line vacuum), which may then create a vacuum under the screen by forcing air through small nozzles and inducing a pressure drop. In this embodiment, a flowline may be coupled to an air or gas source and the timer box and to a hose assembly coupled to the manifold. An eductor may be installed proximate a coupling of the flowline to the hose assembly, such that when air is forced through the eductor (e.g., forcing air through one or more small nozzles proximate the coupling between the flowline and the hose assembly) a pressure drop is induced which creates the pressure differential across the screen (e.g., a vacuum under the screen). In other embodiments, the pressure differential device may include a rig vacuum system and/or fluid eductor/jet nozzle arrangement to provide a pressure differential across the screen. In the embodiment in which the pressure differential device may include a vacuum system, a flowline may be coupled to the vacuum system and coupled to the manifold, such that the flowline may pull both air/vapors and fluid through the screen.

For example, as shown in FIG. 1, a pressure differential device 110 external to the vibratory separator 100 provides a pressure differential to one or more screens 108 disposed in the vibratory separator 100. The pressure differential device 110 is fluidly coupled to a pan or tray 112 via a flowline 114. In the embodiment shown, the pressure differential device 110 includes a timer box and an air or gas source (not shown) that provides air or gas through the flowline 114 to a hose assembly (not shown) coupled to tray 112. As shown in FIG. 1, the pan 112 is disposed in the basket 102 below a first screen 108*a* (the first screen 108*a* being shown removed from the basket). The pan 112 includes an opening 116 through which the pressure differential may be applied to the screen 108. For example, pressure differential device 110 may provide suction below the screen 108 to pull liquids and vapor or air through the screen 108. The location of the opening 116 in the pan 112 may be proximate a feed end or a discharge end of the pan 112 or the opening 116 may be centrally located in the pan 112. The location of the opening 116 may be offset from a central location of the pan 112 such that the opening 116 is closer to a left side or a right side of the screen 108. A bottom of the pan 112 may be angled or sloped from sides of the pan 112 down toward the opening 116 to facilitate removal of any liquids pulled through the screen 108.

Figure 2A:
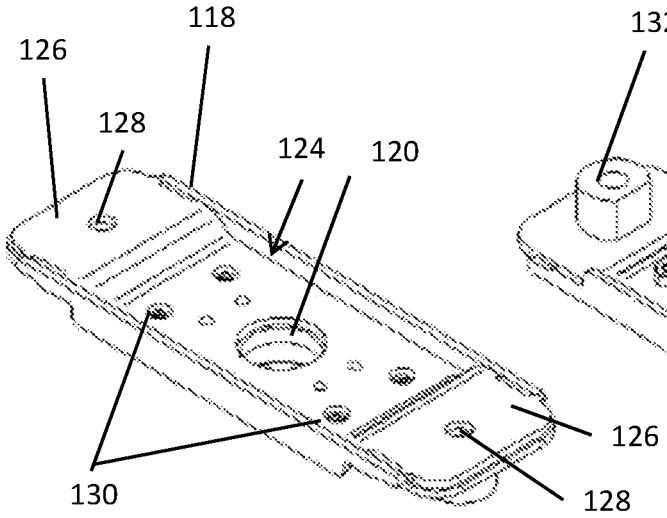
FIG. 2A is a top perspective view of a manifold and FIG. 2B is a bottom perspective view of the manifold in accordance with embodiments disclosed herein.
Figure 2B:
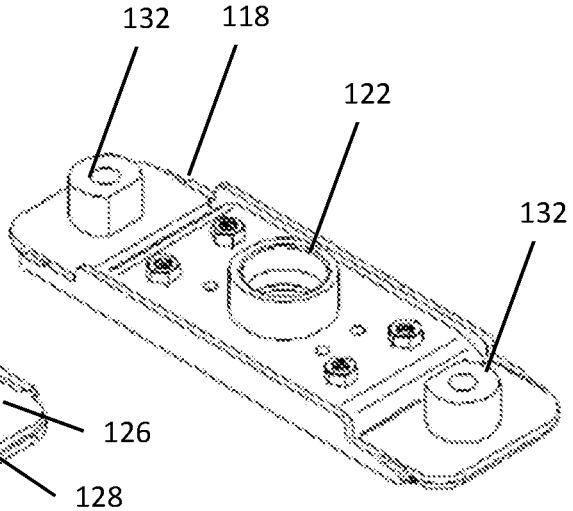
Figure 3:
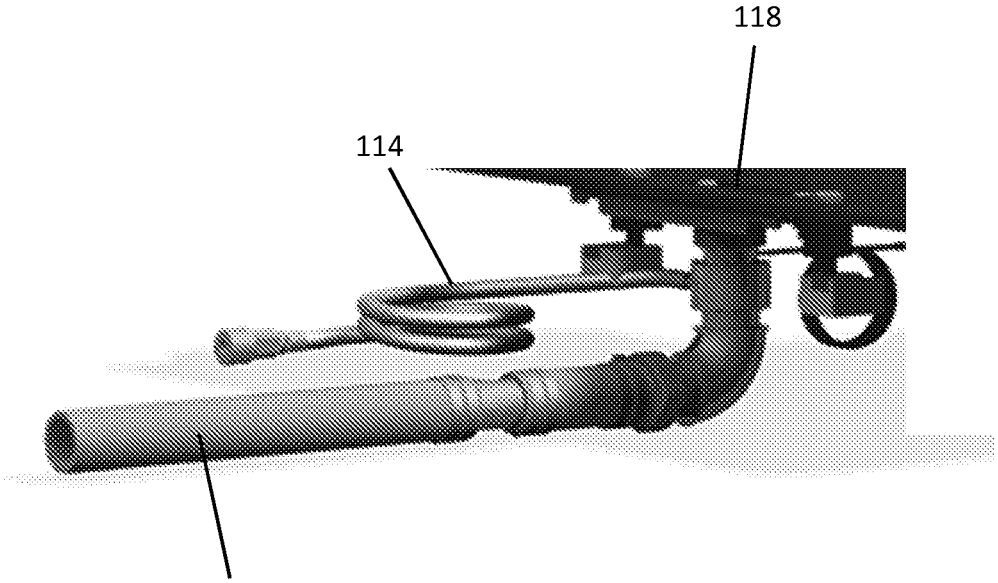
FIG. 3 is a perspective view of a flowline and hose assembly coupled to a manifold in accordance with embodiments disclosed herein.

A manifold 118, as shown in FIGS. 2A and 2B, may be used to couple the pan 112 to the vibratory separator. The flowline 114 is fluidly coupled to the pan 112 through the manifold 118. The manifold 118 is a plate-like structure with an opening 120 extending through the plate-like structure to provide fluid flow there through. As shown in FIG. 3, the flowline 114 may be coupled to a hose assembly 115 that is coupled to a bottom of the manifold 118. Referring to FIGS. 2A, 2B, and 3 together, the opening 120 may have a diameter that corresponds to a diameter of a hose assembly 115. The manifold 118 is configured to couple to the basket 102 of the vibratory separator and the pan 112 is configured to be secured to the manifold 118. The manifold may provide structural support and/or rigidity to the pan 112 when installed so as to prevent wear and/or cracking of the pan 112. When the manifold 118 is installed, the flowline 114 is coupled to the hose assembly 115 coupled to the bottom of the manifold 118. As shown, the manifold 118 may include a cylindrical portion 122 on the bottom of the manifold aligned with the opening 120 and configured to receive the hose assembly 115. The hose assembly 115 may be inserted into the cylindrical portion 122 (i.e., an inner diameter of the cylindrical portion 122 is approximately equal to or slightly larger than an outer diameter of the hose assembly 115) or the hose assembly 115 may fit over the cylindrical portion 122 (i.e., an inner diameter of the hose assembly 115 may be approximately equal to or slightly less than an outer diameter of the cylindrical portion 122). The hose assembly 115 may be coupled to the cylindrical portion 122 using any method or apparatus known in the art, for example, threaded coupling, a mechanical fastener, adhesive, etc. In other embodiments, a joint, such as an elbow joint (123, FIG. 7), may be coupled to the cylindrical portion 122 and the hose assembly 115 may then be coupled to the elbow joint by any method known in the art to allow fluid flow through the hose assembly 115 and manifold 118. The flowline 114 may be coupled to the hose assembly 115 by any method known in the art. The hose assembly 115 may include a coupling configured to receive the flowline 114. The coupling may include an eductor (not shown) so that when air or gas is supplied by the flowline 114 to the hose assembly 115 proximate the opening 120 of the manifold 118, a pressure drop is induced thereby creating a vacuum below the screen (108, FIG. 1). Liquids pulled through the screen (108, FIG. 1) may then be discharged through the hose assembly 115.

In other embodiments in which the pressure differential device (110, FIG. 1) includes a vacuum system (not shown), the flowline 114 may couple a vacuum device (not shown) to the manifold 118. In this embodiment, a vacuum is applied to the area below the screen (108, FIG. 1) through the flowline 114 and liquid and air/vapor pulled through the screen (108, FIG. 1) is pulled through the flowline 114 as the vacuum is applied. In this embodiment, the opening 120 may have a diameter that corresponds to a diameter of the flowline 114. The manifold 118 is configured to couple to the basket 102 of the vibratory separator and the pan 112 is configured to be secured to the manifold 118. The manifold may provide structural support and/or rigidity to the pan 112 when installed so as to prevent wear and/or cracking of the pan 112. When the manifold 118 is installed, the flowline 114 is coupled to a bottom of the manifold 118. As shown, the manifold 118 may include a cylindrical portion 122 on the bottom of the manifold aligned with the opening 120 and configured to receive the flowline 114. The flowline 114 may be inserted into the cylindrical portion 122 (i.e., an inner diameter of the cylindrical portion 122 is approximately equal to or slightly larger than an outer diameter of the flowline 114) or the flowline 114 may fit over the cylindrical portion 122 (i.e., an inner diameter of the flowline 114 may be approximately equal to or slightly less than an outer diameter of the cylindrical portion 122). The flowline 114 may be coupled to the cylindrical portion 122 using any method or apparatus known in the art, for example, threaded coupling, a mechanical fastener, adhesive, etc. In other embodiments, a joint, such as an elbow joint (123, FIG. 7), may be coupled to the cylindrical portion 122 and the flowline 114 may then be coupled to the elbow joint by any method known in the art to allow fluid flow through the flowline 114 and manifold 118.

The manifold 118 may include a central region 124 between two end regions 126. In one embodiment, the central region 124 may be a recessed region that opens toward a top end of the manifold 118. A transition between the central, recessed region 124 and the end regions 126 may be tapered, curved, or vertical. A length of the recessed region 124 may be selected such that the central, recessed region 124 fits between support structure (not shown) in a basket (102, FIG. 1) of a vibratory separator (100, FIG. 1). In other embodiments, the manifold 118 may not include a recessed region, but rather, may be a plate-like structure having two end regions. The end regions 126 are configured to sit on or engage the support structure (not shown), as will discussed in more detail below.

Still referring to FIGS. 2A, 2B, and 3, manifold 118 may also include a plurality of openings 128 configured to receive mechanical fasteners which couple the manifold 118 to the basket (102, FIG. 1) and/or the pan (112, FIG. 1). As shown, the manifold 118 may include an opening 128 on each of the end regions 126. In one embodiment, the openings 128 may be, for example, counter bores. The openings 128 on the end regions 126 are configured to accommodate mechanical fasteners (not shown) to couple the manifold 118 to the basket (102, FIG. 1). As shown and described below, these mechanical fasteners may include, for example, bolts and nuts. The manifold 118 may also include cylindrical portions 132 extending from a bottom surface of the end regions 126, each cylindrical portion 132 aligned with the openings 128. The cylindrical portions 132 aligned with the openings 128 may help guide or stabilize the mechanical fasteners (not shown) when assembled with the manifold.

Openings 130 on the central region 124 of the manifold 118 are configured to accommodate mechanical fasteners (not shown) to couple the manifold 118 to the pan (112, FIG. 1). As shown and described below, these mechanical fasteners may include, for example, bolts and nuts. In other embodiments, the pan may be coupled to the manifold using other devices or methods such as, for example, magnets, air bladders, welding, adhesives, etc. Further, in some embodiments, the pan and manifold may be integrally formed.

Referring to FIGS. 1-3, the manifold 118 may be installed in a basket 102 of a vibratory separator 100 in a location such that when the pan 112 is installed in the basket 102, the opening 116 of the pan 112 is aligned with the opening 120 of the manifold 118 and fluidly coupled to the flowline 114 and hose assembly 115. For example, in the embodiment shown in FIG. 1, the opening 116 of the pan 112 is located proximate an end of the screen 108 closer to the feed end 134 of the separator than the discharge end 136. The manifold 118 may be coupled to support structure of the basket 102, for example, support structure for supporting the screen 108 disposed in the basket 102, which may include the screen bed or cross members of the basket 102.

Figure 7:
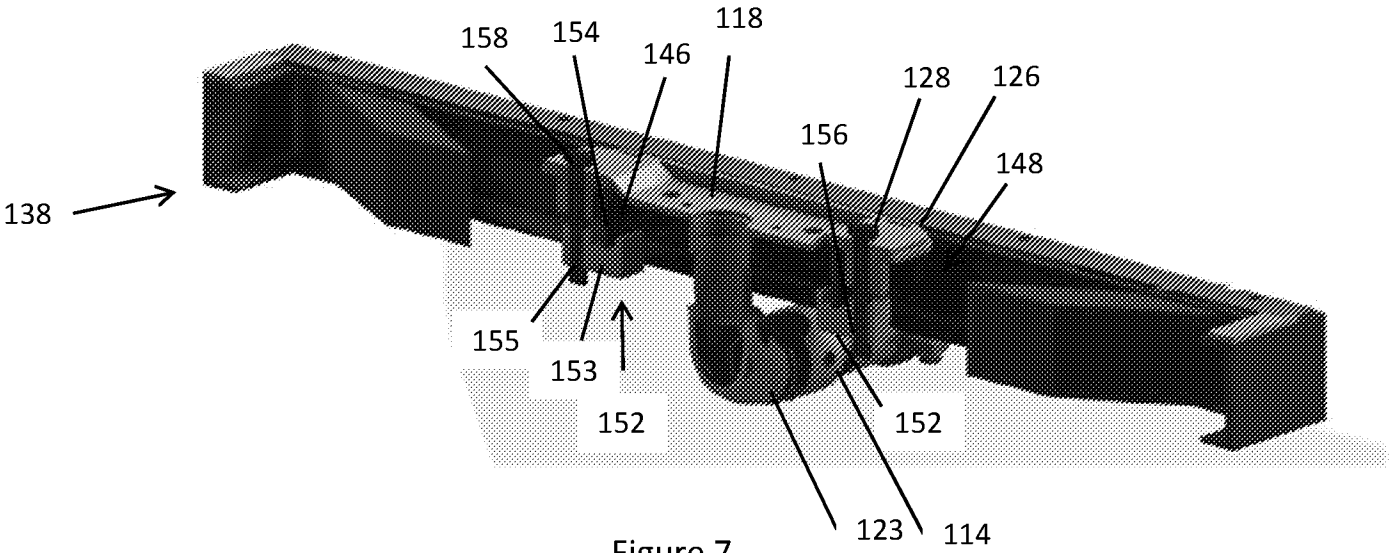
FIG. 7 is a partial perspective view of the manifold of FIGS. 4-6.
Figure 9:
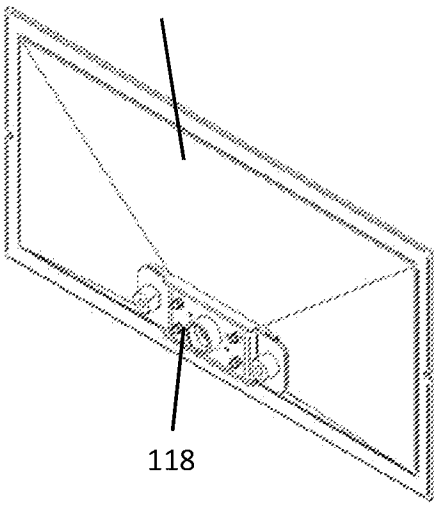
FIG. 9 is a perspective view of the manifold coupled to the pan of FIG. 8.
Figure 8:
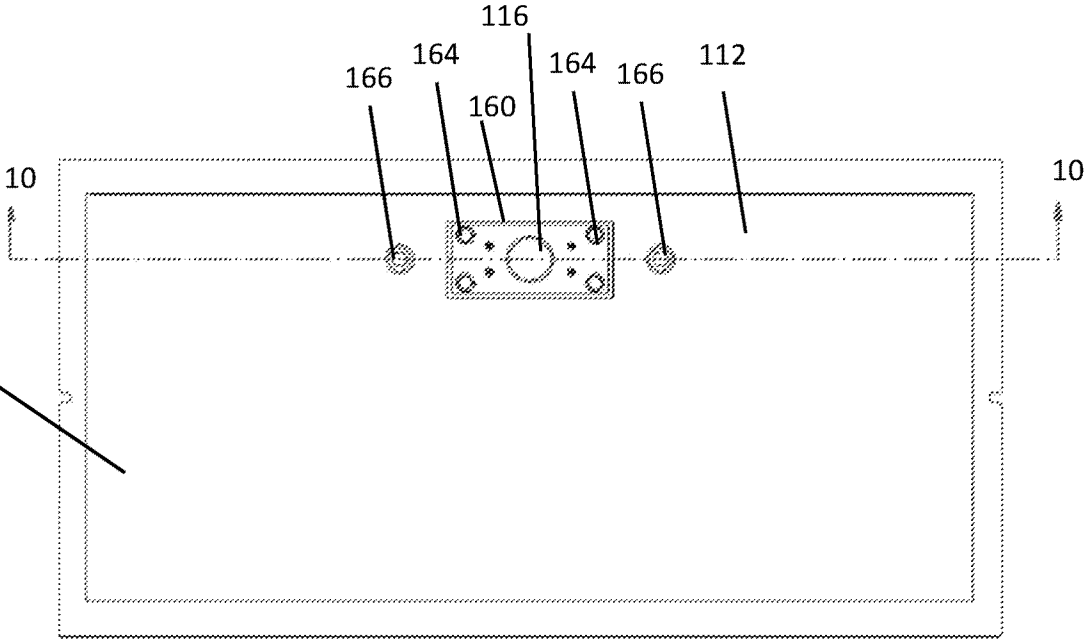
FIG. 8 is a top view of a manifold coupled to a pan in accordance with embodiments disclosed herein.
Figure 10:
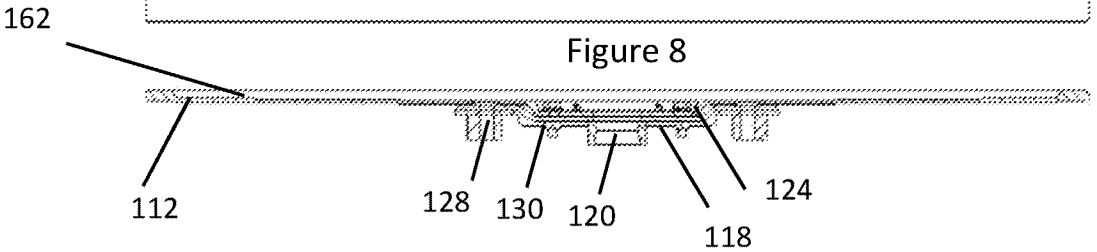
FIG. 10 is a cross-sectional view taken along line 10-10 in FIG. 8.
Figure 12:
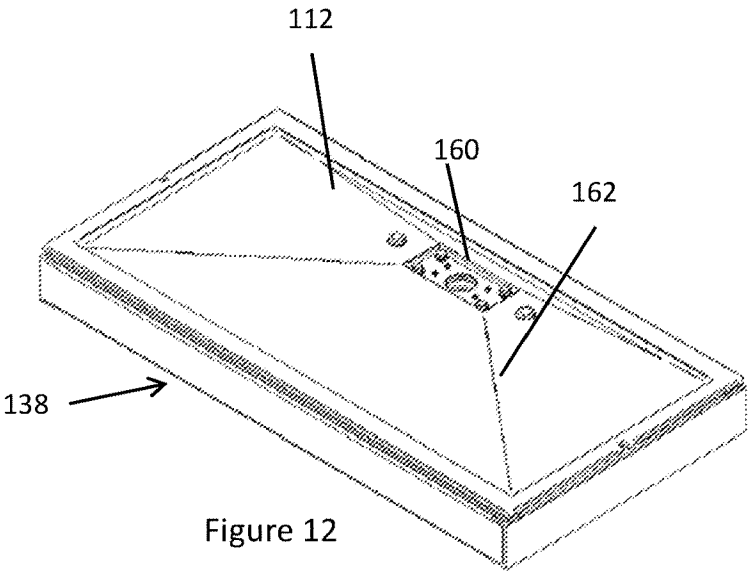
FIG. 12 is a perspective view of FIG. 11.
Figure 11:
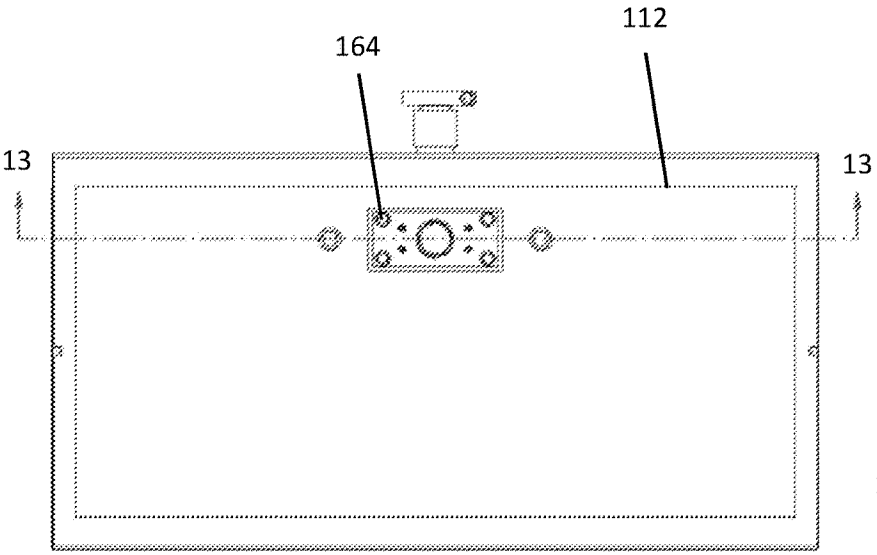
FIG. 11 is top view of a manifold coupled to a basket of a separator and a pan in accordance with embodiments disclosed herein.

One of ordinary skill in the art will appreciate that a manifold in accordance with embodiments disclosed herein may be configured to be secured to various configurations of support structure of a basket of a vibratory separator. For example, size, shape, bolt hole configuration, recessed regions, etc. may be varied in order to accommodate the size, shape, and/or configuration of a basket 102 and its support structure so that the manifold may be securely coupled to the basket 102 and configured to couple to and support the pan 112 of a pressure differential system for a vibratory separator. FIGS. 4-18 show an example of a pressure differential system for a vibratory separator wherein a manifold is installed in a basket having support structure with angled cross members. FIGS. 19-30 show another example of a pressure differential system for a vibratory separator wherein a manifold is installed in a basket having support structure with square cross members. FIGS. 8-10 show an assembly of a manifold and a pan which may be used in the example pressure differential systems. Accordingly, like elements are represented by like reference numerals and such components may be interchangeable between example pressure differential systems.

Figure 4:
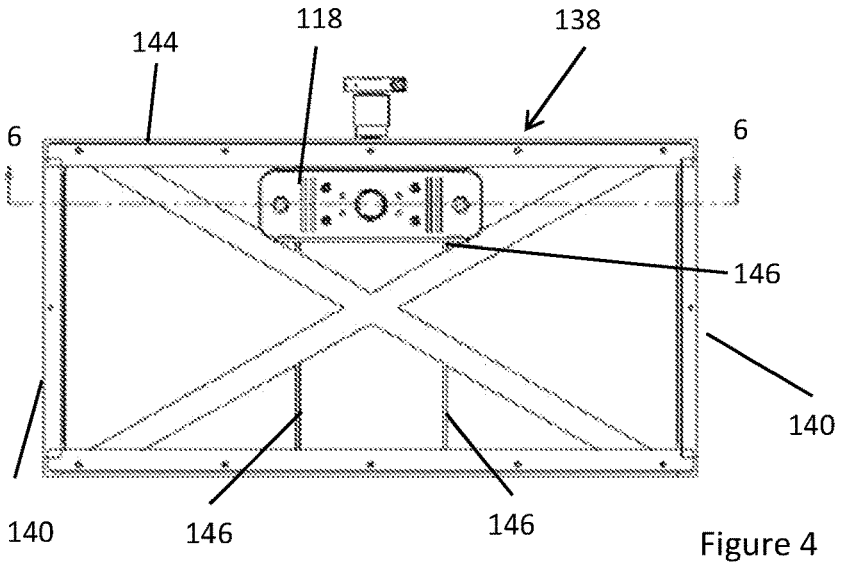
FIG. 4 is a top view of a manifold disposed in a basket of a separator in accordance with embodiments disclosed herein.
Figure 5:
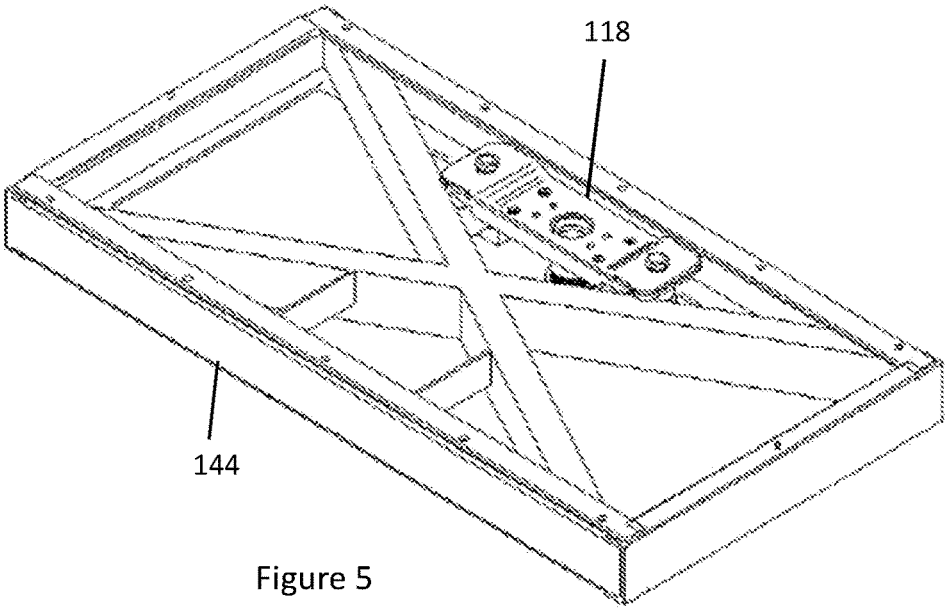
FIG. 5 is a perspective view of the manifold of FIG. 4.
Figure 6:
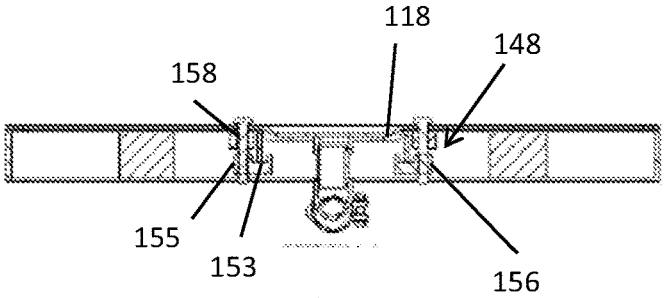
FIG. 6 is a cross-sectional view taken along line 6-6 in FIG. 4.

Referring now to FIGS. 4-6, manifold 118 is installed on support structure 138 of the basket (102, FIG. 1). The manifold 118 is disposed on the support structure 138 and clamped to the support structure 138 to secure the manifold in place, as described in more detail below. The manifold 118 is coupled to the support structure 138 within a perimeter of support structure 138 that defines or corresponds to a perimeter of a screen (108, FIG. 1) disposed on the support structure 138. As discussed above, the manifold 118 is positioned such that, once the pan (112, FIG. 1) of the pressure differential system is installed in the vibratory separator, the manifold 118 is located below the opening (116, FIG. 1) of the pan (112, FIG. 1). As shown, the manifold 118 is located toward the feed end 134 of the support structure 138 and centrally located between sides 140 of the support structure 138. In this embodiment, support structure 138 also includes angled cross members 142. In other words, the crossing angled cross members extend from the sides 140 and ends 144 of the support structure 138 at acute or obtuse angles, or in other words, at an angle other than 90 degrees. At least two transverse members 146 extend between each of the ends 144 and the angled cross members 142, as shown in FIG. 4. The at least two transverse members 146 may extend perpendicularly from the ends 144. Manifold 118 is coupled to these transverse members 146 such that end regions 126 of the manifold 118 are disposed on and overhang the two transverse members 146. The central, recessed region 124 of manifold 118 is disposed between the two transverse members 146 and may help align and secure the manifold 118 between the two transverse members 146.

A clamping device 148, shown in FIG. 6, is coupled to the manifold 118 with a mechanical fastener, such as a bolt 158, threaded rod, stud, etc., and used to secure the manifold 118 to the transverse members 146. As shown in more detail in FIG. 7, the clamping device 148 includes at least two clamping blocks 152 for engaging a bottom surface of the support structure 138. The clamping blocks 152 may be identical but oriented in an opposing manner or in the same manner, as discussed below. In one embodiment, each clamping block 152 includes a recess or groove 154 in a first portion 153 of the clamping block 152 that extends along a length of the clamping block 152. The groove 154 opens toward a top side of the clamping block and is configured to receive the support structure 138, such as the transverse members 146, of the basket (102, FIG. 1). The profile of the groove 154 may correspond to a profile of a bottom surface of the transverse members 146. For example, the profile of the bottom surface of the transverse members 146, and therefore the profile of the groove 154, may be square, rounded, triangular, etc. A width of the groove 154 may be approximately equal to or greater than a width of the transverse members 146. In other embodiments, the clamping blocks 152 may include an upper surface without a groove, for example, a flat surface, wherein the upper surface is configured to contact or engage the support structure 138, such as the transverse members 146. The clamping block 152 also includes a bore 156 in a second portion 155 of the clamping block 152 extending downward from a top side of the clamping block 152. The bore 156 is configured to receive a mechanical fastener, such as a bolt 158, threaded rod, stud, etc. As shown in FIG. 7, the bore 156 may be a threaded bore configured to receive the bolt 158. In some embodiments, washers, nuts, weldnuts, etc. may be used to further secure the bolt 158 to the clamping block 152.

Bolts 158 are inserted into the openings 128 on each of the end regions 126 of manifold 118. The openings 128 are located on the end regions 126 such that when the manifold 118 is installed on the support structure 138 of the basket 102, the openings 128 are positioned laterally outside of the transverse members 146. Two clamping blocks 152 are coupled to the manifold with the bolts 158 which extend down from the end regions 126 of the manifold 118 and are inserted in the bores 156 of the clamping blocks 152. In this embodiment, the first portion 153 of each clamping block 152 is oriented laterally inward of the second portion 155 of the clamping block 152. In other words, in the embodiment shown, the groove 154 of each clamping block 152 is oriented inward of the bore 156 from the sides 140 of the support structure 138. Thus, during installation, the manifold 118 is disposed on and between the two transverse members 146, the two clamping blocks 152 are coupled to the manifold 118 with bolts 158 such that the bottom surfaces of the transverse members 146 engage the grooves 154 of the two clamping blocks 152, and the bolt is tightened to clamp the manifold 118 to the transverse members 146. One of ordinary skill in the art will appreciate that depending on the configuration of the support structure of a vibratory separator, the orientation of the clamping blocks 152 may be altered. For example, in one embodiment, the clamping blocks 152 may be oriented the same such that one clamping block has a first portion oriented laterally inward towards the opening 120 of the manifold, while a second clamping block has a first portion oriented laterally outward from the opening 120.

Once the manifold 118 is clamped onto the support structure 138, the flowline 114 may be coupled to the manifold 118 to connect the manifold 118 to the pressure differential device (110, FIG. 1). In the embodiment show, the flowline 114 may be coupled to the hose assembly 115 to fluidly couple the flowline 114 to the manifold 118. Further, the pan 112 may be coupled to the manifold 118, as shown in FIGS. 8-10. As discussed above, the pan 112 may be installed in the vibratory separator such that the opening 116 of the pan 112 aligns with the opening 120 of the manifold 118. The pan 112 may further include a recessed region 160 which corresponds to the recessed region 124 of the manifold 118. The recessed region 160 of the pan 112 is located such that the opening 116 of the pan 112 is located within the recessed region 160. The shape and/or profile of the recessed region 160 of the pan 112 corresponds to the shape and/or profile of the manifold 118, such that the recessed region 160 of the pan 112 may be disposed within or sit in the central, recessed region 124 of the manifold 118 when assembled. For example, as shown, the recessed regions 124, 160 are rectangular in shape; though any shaped recessed region, including square, oval, circular, etc. may be used without departing from the scope of embodiments disclosed herein. A transition between the recessed region 160 of the pan 112 and an upper surface 162 of the pan 112 may be tapered, curved, or vertical and may or may not match the profile of the transition between the recessed region 124 and the end regions 126 of the manifold 118.

The pan 112 may also include a plurality of openings 164 in the recessed region 160 that correspond to the openings 130 on the recessed region 124 of the manifold and configured to accommodate mechanical fasteners (not shown). The mechanical fasteners, e.g., bolts, threaded rods, studs, etc., may be inserted into the openings 164 in the recessed region 160 of the pan and into the openings 130 of the recessed region 124 of the manifold 118 and secured with, for example washers, nuts, weldnuts, etc. to couple the pan 112 to the manifold 118. In some embodiments, the pan 112 may also include openings 166 that correspond to the openings 128 on the end regions 126 of the manifold 118. The openings 166 may be located outside of the recessed region 160 of the pan, for example, through a sloped or flat portion of the bottom of the pan 112. The openings 166 may accommodate heads of the bolts (158, FIG. 7) used to secure the manifold 118 to the support structure (138, FIG. 7).

Figure 13:
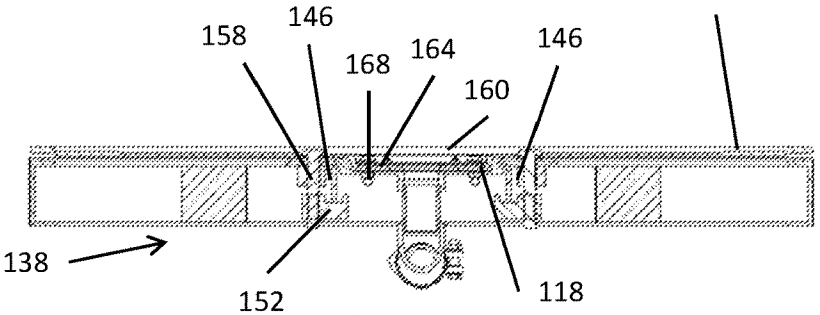
FIG. 13 is a cross-sectional view taken along line 13-13 in FIG. 11.
Figure 14:
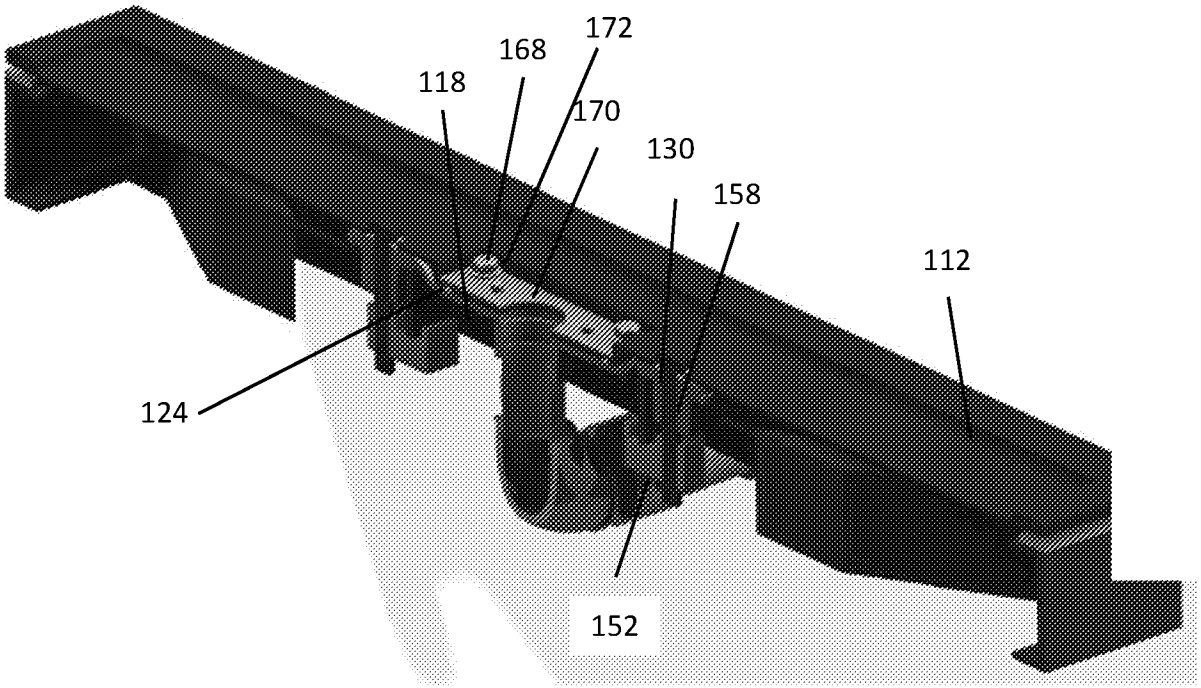
FIG. 14 is a partial perspective view of the manifold, basket, and pan of FIGS. 11-13.
Figure 16:
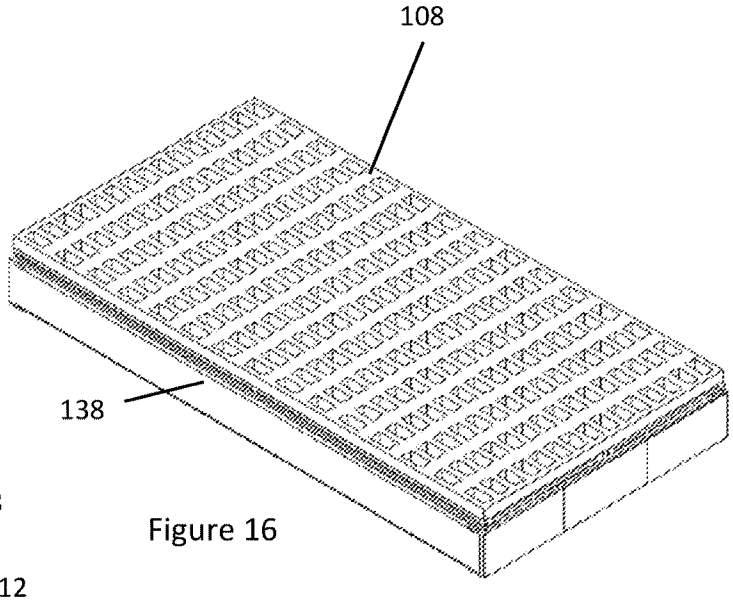
FIG. 16 is a perspective view of FIG. 15.
Figure 15:
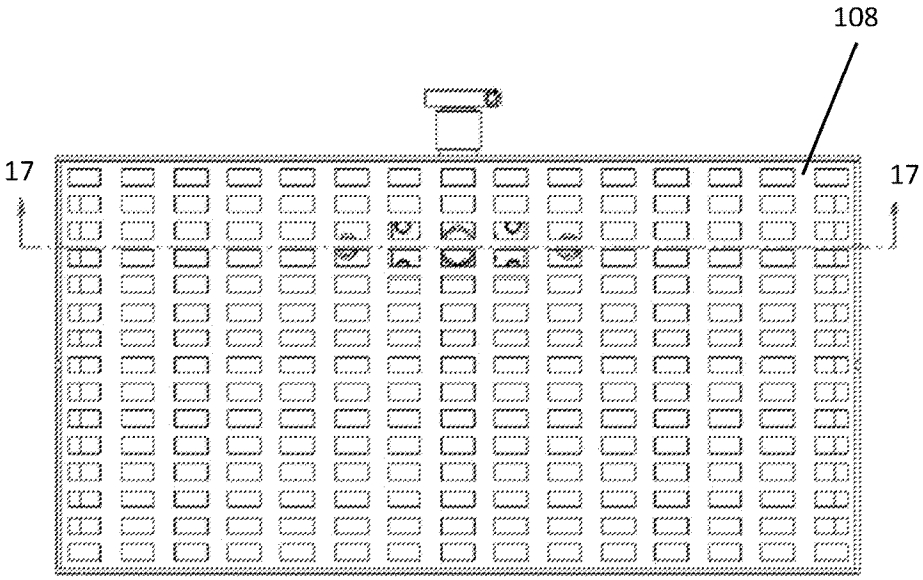
FIG. 15 is a top view of a manifold coupled to a basket of a separator and a pan with a screen disposed thereon in accordance with embodiments disclosed herein.
Figure 17:
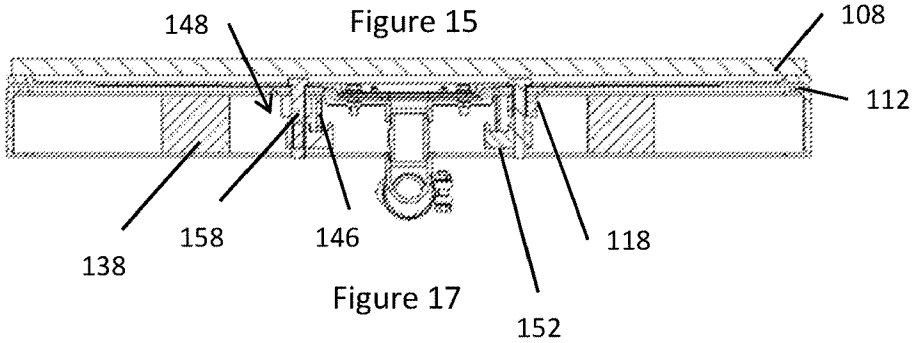
FIG. 17 is a cross-sectional view taken along line 17-17 in FIG. 15.
Figure 18:
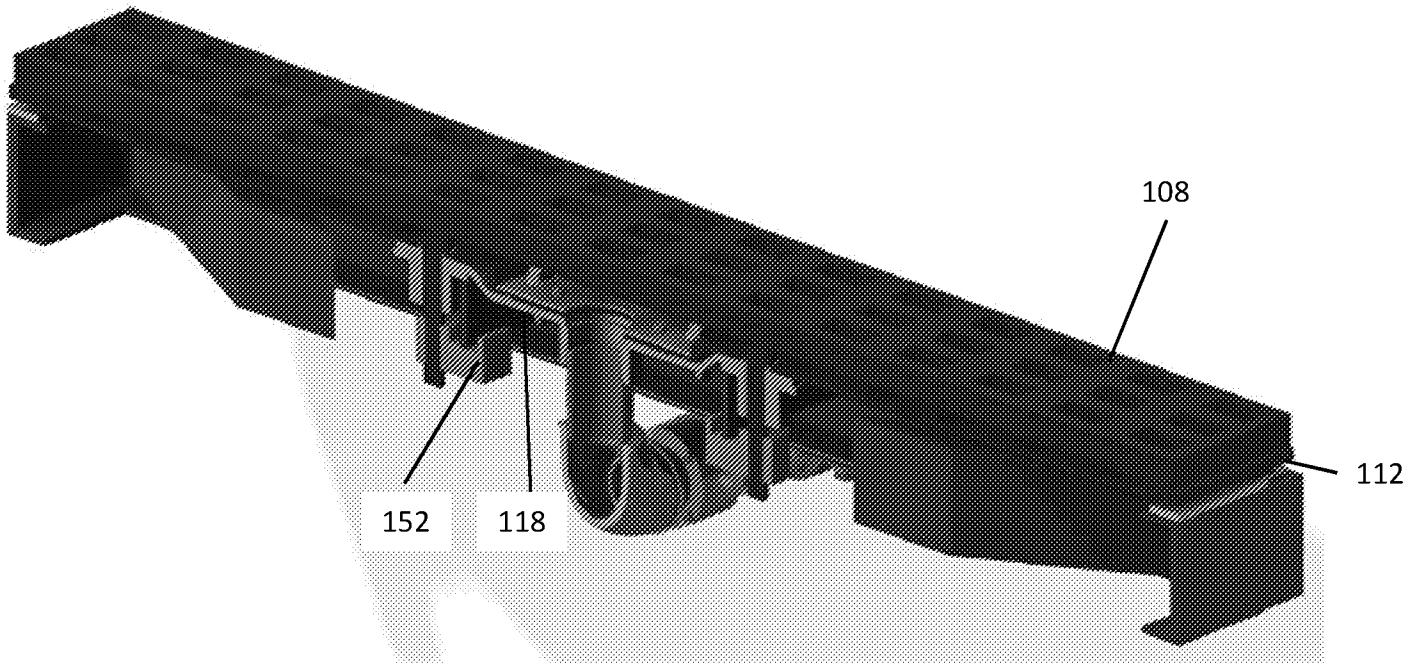
FIG. 18 is a partial perspective view of the manifold, basket, pan, and screen of FIGS. 15-17.

FIGS. 11-14 show an assembly of the support structure 138, the manifold 118, and the pan 112. As shown in FIGS. 13 and 14, the manifold 118 is positioned between two transverse members 146 of the support structure 138 and secured to the transverse members 146 with the clamping blocks 152 clamped on to the bottom surface of the transverse members 146. Bolts 158 lock the manifold 118 to the clamping blocks 152. The pan 112 is installed on the support structure 138 and coupled to the manifold 118 with bolts 168 extending through openings 164 in the recessed region 160 of the pan 112 into the openings 130 of the recessed region 124 of the manifold 118. In some embodiments, a plate 170 having a shape or profile that corresponds to the recessed region 160 of the pan 112 and having a plurality of openings 172 that corresponds to the openings 164 in the recessed region 160 of the pan 112 and the openings 130 of the recessed region 124 of the manifold 118 may be installed in the recessed region 160 of the pan 112. In this embodiment, the plate 170 may be secured with the bolts 168 to the pan and, therefore, the manifold. The plate 170 may act as a wear plate to protect the pan 112 from wear, cracking, etc.

FIGS. 15-18 show an assembly of the support structure 138, manifold 118, clamping device 148, pan 112, and screen 108. After the pan is coupled to the manifold as described above, the screen may be installed on support structure 138 over the pan 112. Wedges (not shown) may be used to secure the screen 108 in the vibratory separator (100, FIG. 1) and clamp the screen 108 down on the pan 112. As known in the art, wedges may be inserted above the screen 108 and below wedging brackets (171, FIG. 1) to secure the screen 108 in place. However, one of ordinary skill in the art will appreciate that the screens may be secured inside the vibratory separator by any means known in the art, for example, air bladders, magnets, etc.

Figure 20:
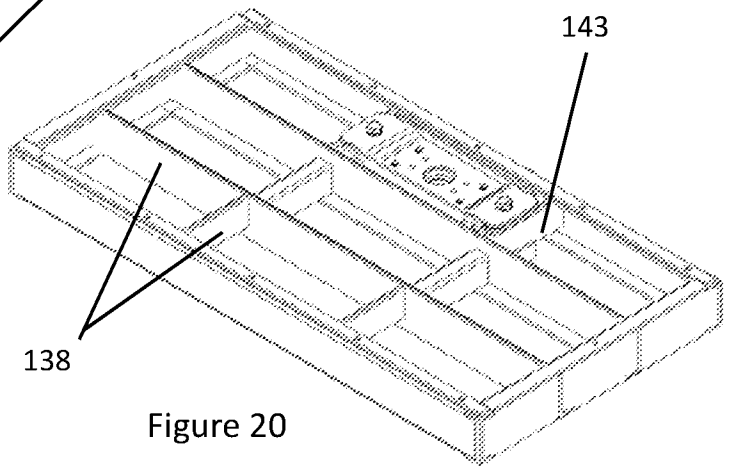
FIG. 20 is a perspective view of the manifold of FIG. 19.
Figure 19:
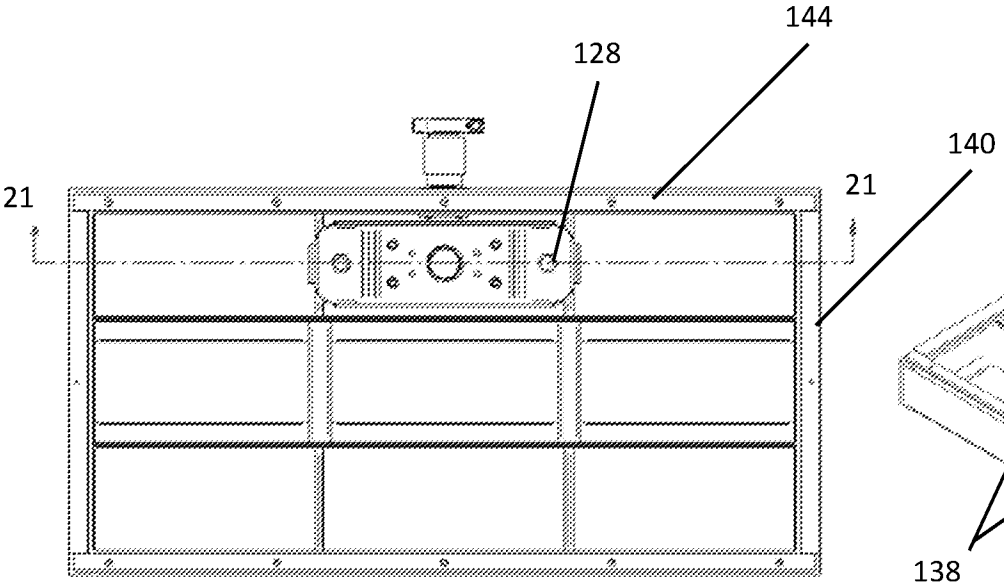
FIG. 19 is a top view of a manifold disposed in a basket of a separator in accordance with embodiments disclosed herein.
Figure 21:
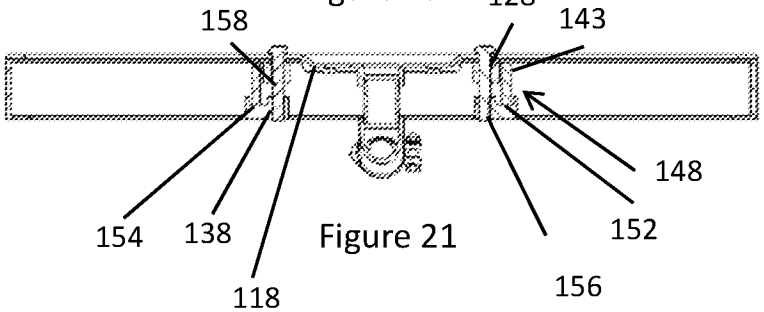
FIG. 21 is a cross-sectional view taken along line 21-21 in FIG. 19.
Figure 22:
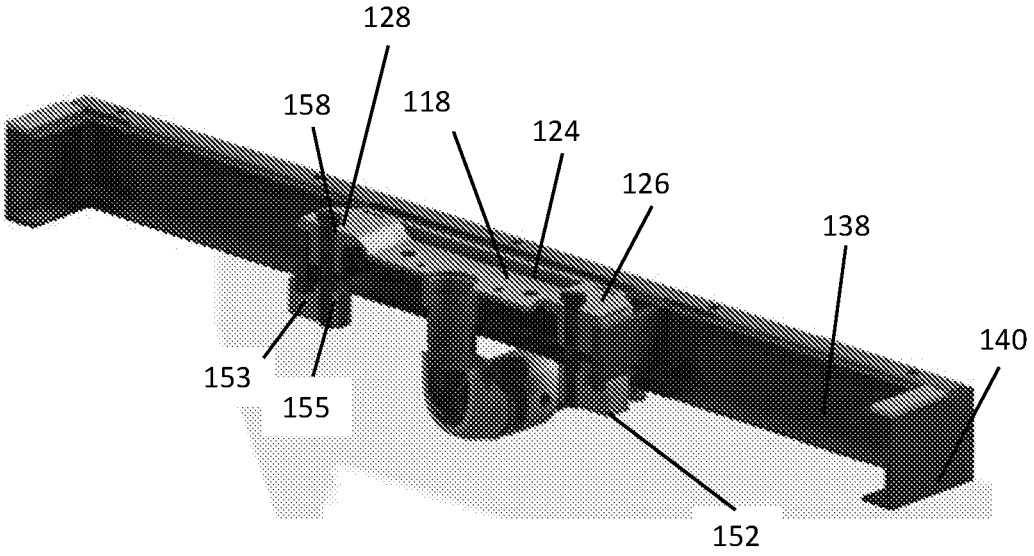
FIG. 22 is a partial perspective view of the manifold of FIGS. 19-21.
Figure 24:
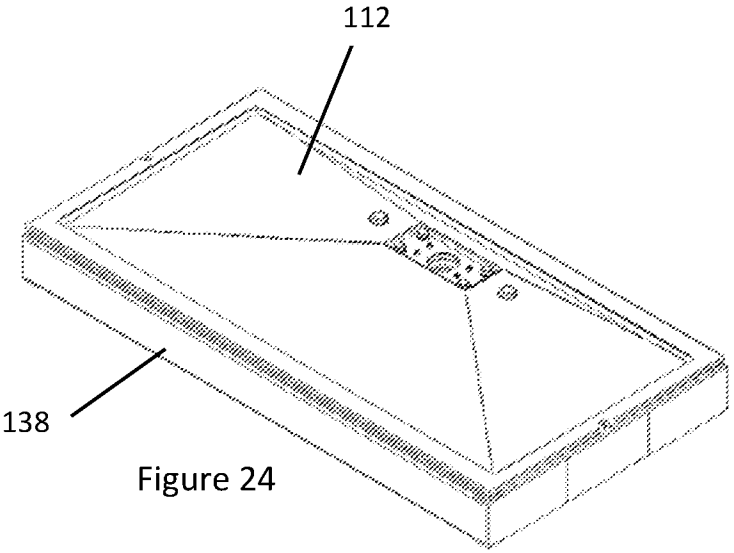
FIG. 24 is a perspective view of FIG. 23.
Figure 23:
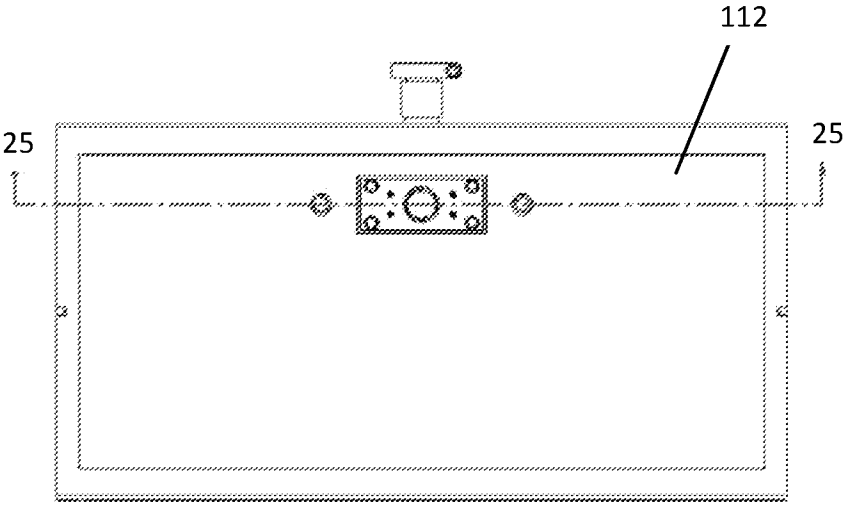
FIG. 23 is top view of a manifold coupled to a basket of a separator and a pan in accordance with embodiments disclosed herein.

As discussed above, FIGS. 19-30 show another embodiment of a pressure differential system with the manifold clamped to support structure of the basket of a vibratory separator with the pan coupled and screen coupled thereto. In this embodiment, the support structure 138 includes square cross members 143, as shown in FIGS. 19 and 20. In other words, the cross members of the support structure 138 are oriented at 90 degree angles from the sides 140 and the ends 144. The manifold 118 is coupled to the square cross members 143 extending from an end 144 with a clamping device 148 similar to that described above with reference to FIG. 6. In this embodiment, however, as shown in FIGS. 21 and 22, the openings 128 of the manifold 118 are located on the end regions 126 such that when the manifold 118 is installed on the support structure 138 of the basket 102, the openings 128 are positioned laterally inward of the square cross members 143. Two clamping blocks 152 are coupled to the manifold 118 with the bolts 158 which extend down from the end regions 126 of the manifold 118 and are inserted in the bores 156 of the clamping blocks 152. Further, in this embodiment, the first portion 153 of each clamping block 152 is oriented laterally outward of the second portion 155 of the clamping block 152. In other words, the groove 154 of each clamping block 152 is oriented outward of the bore 156 from the sides 140 of the support structure 138.

Figure 25:
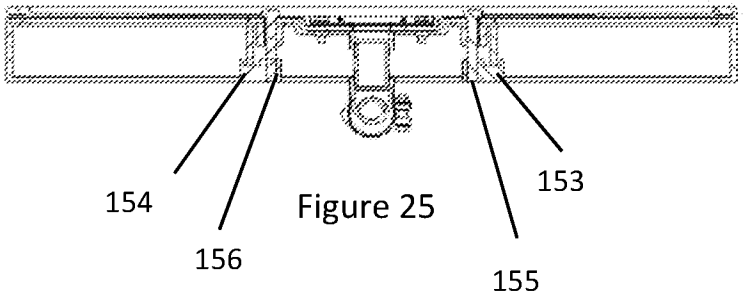
FIG. 25 is a cross-sectional view taken along line 25-25 in FIG. 23.
Figure 26:
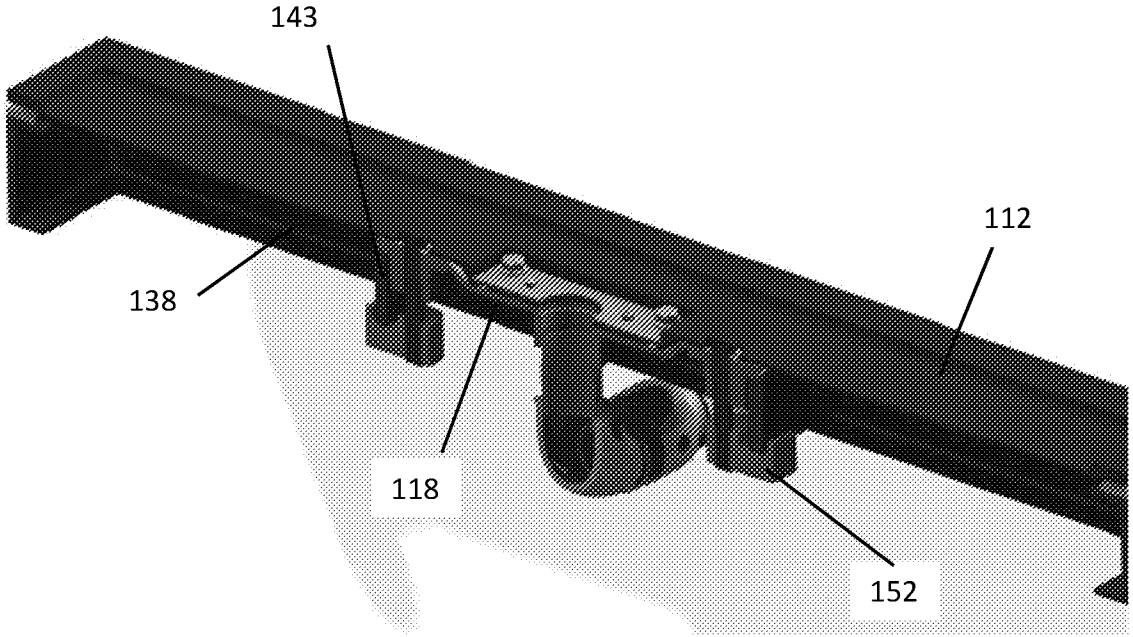
FIG. 26 is a partial perspective view of the manifold, basket, and pan of FIGS. 23-25.
Figure 28:
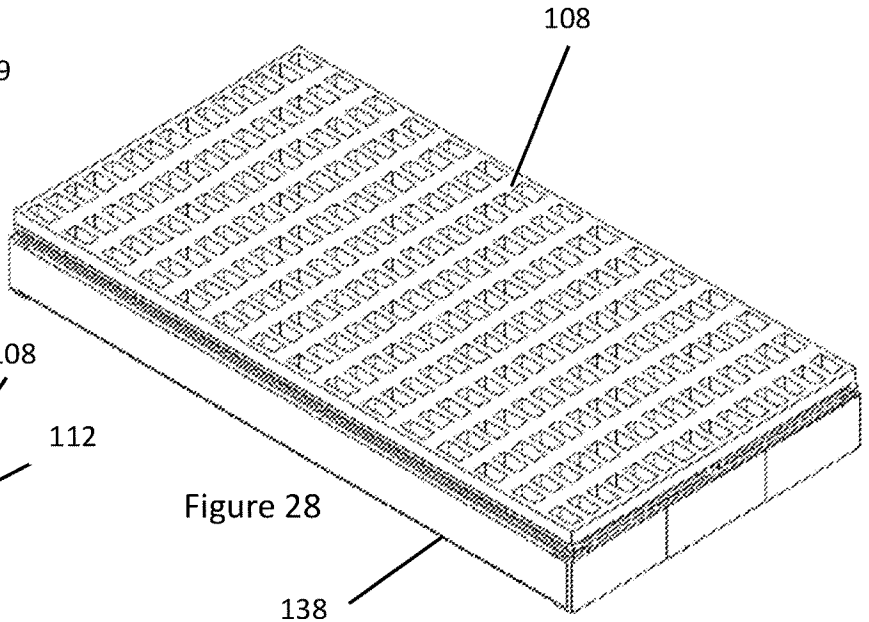
FIG. 28 is a perspective view of FIG. 27.
Figure 27:
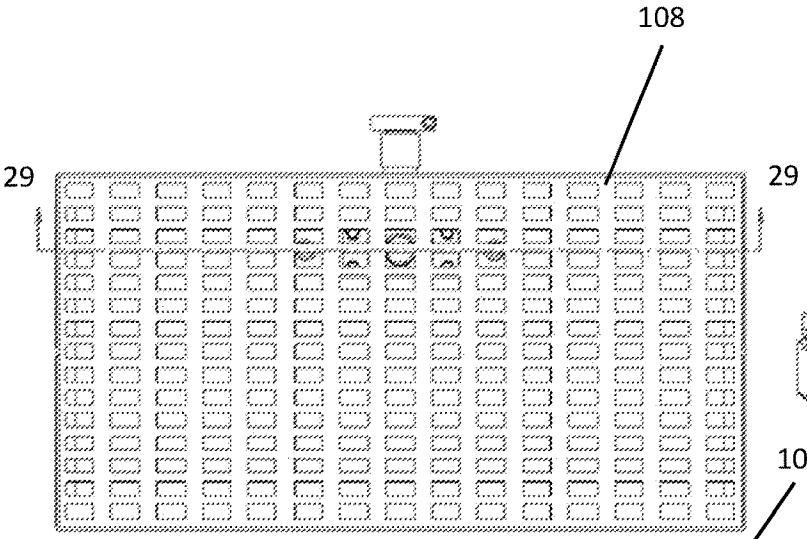
FIG. 27 is a top view of a manifold coupled to a basket of a separator and a pan with a screen disposed thereon in accordance with embodiments disclosed herein.
Figure 29:
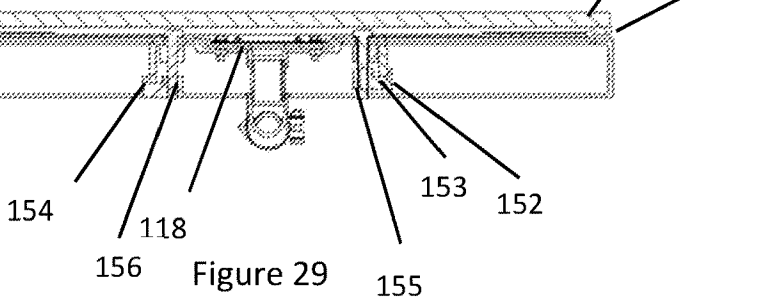
FIG. 29 is a cross-sectional view taken along line 29-29 in FIG. 27.
Figure 30:
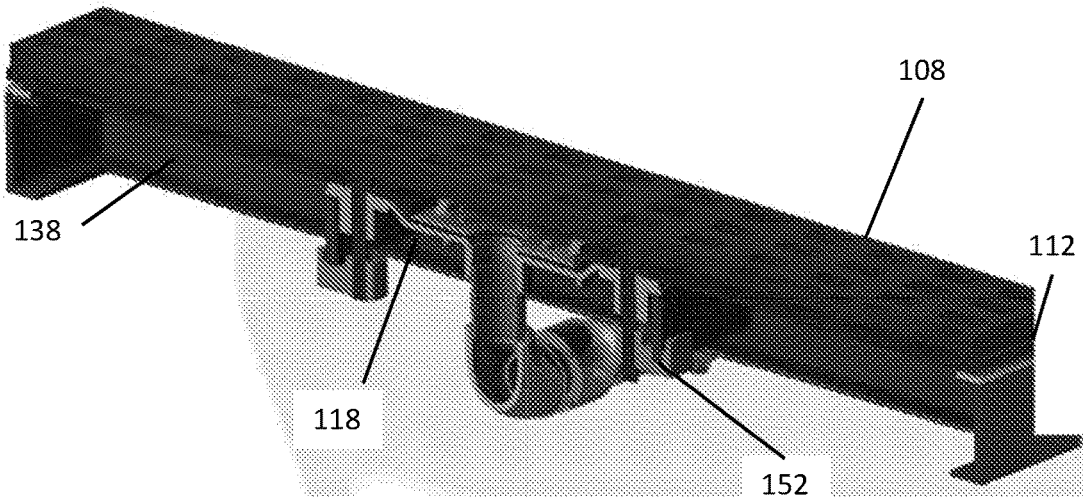
FIG. 30 is a partial perspective view of the manifold, basket, pan, and screen of FIGS. 27-29.

The pan 112 is coupled to the manifold 118 as described above with reference to FIGS. 8-10. Similarly, FIGS. 23-26 show an assembly of the support structure 138, manifold 118, and pan 112 as discussed above with reference to FIGS. 11-14, except, as shown in FIGS. 25 and 26, the first portion 153 of each clamping block 152 is oriented laterally outward of the second portion 155 of the clamping block 152. In other words, the groove 154 of each clamping block 152 is oriented outward of the bore 156 from the sides 140 of the support structure 138. FIGS. 27-30 show an assembly of the support structure 138, manifold 118, clamping device 148, pan 112, and screen 108 as discussed above with reference to FIGS. 15-18, except, as shown in FIGS. 29 and 30, the first portion 153 of each clamping block 152 is oriented laterally outward of the second portion 155 of the clamping block 152.

Figure 33:
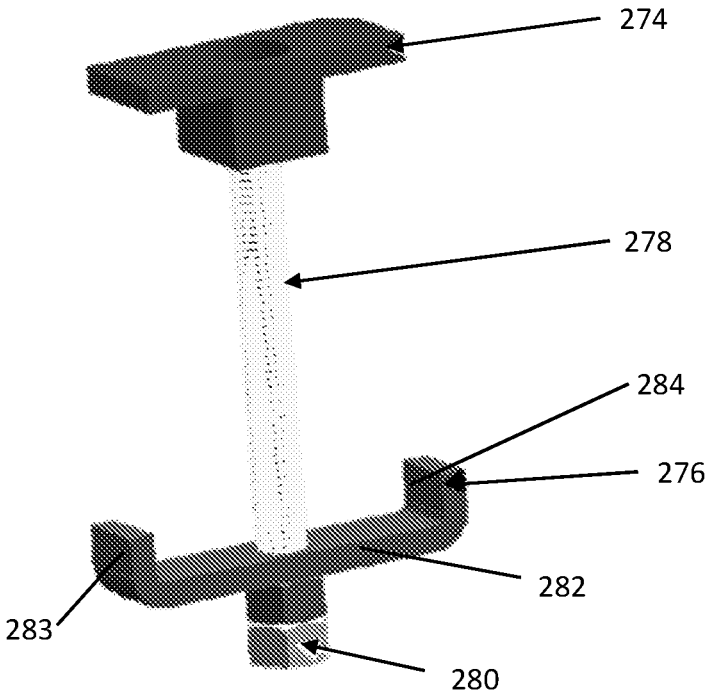
FIG. 33 is a perspective view of the clamp of FIG. 32 in accordance with embodiments disclosed herein.
Figure 34:
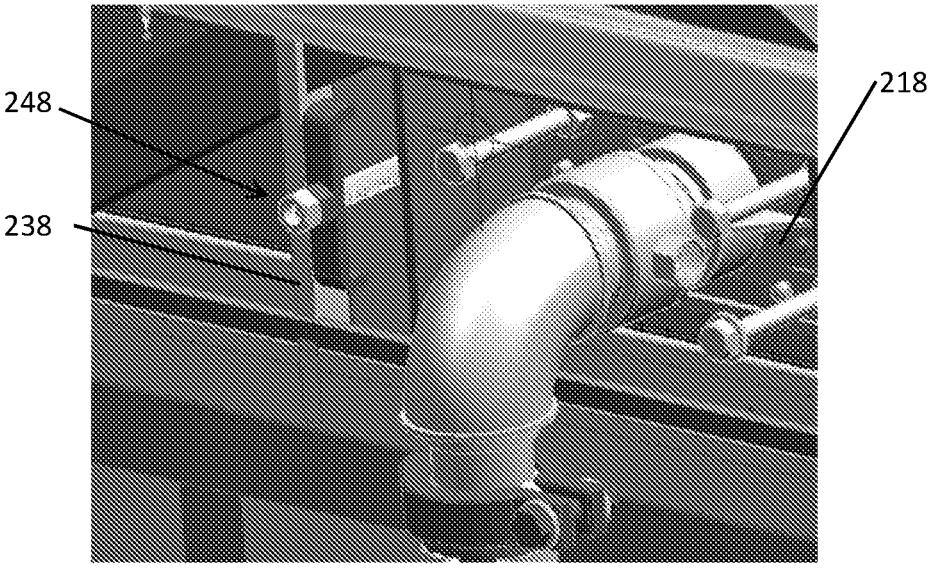
FIG. 34 is a bottom perspective view of the clamp of FIG. 32 during installation.
Figure 35:
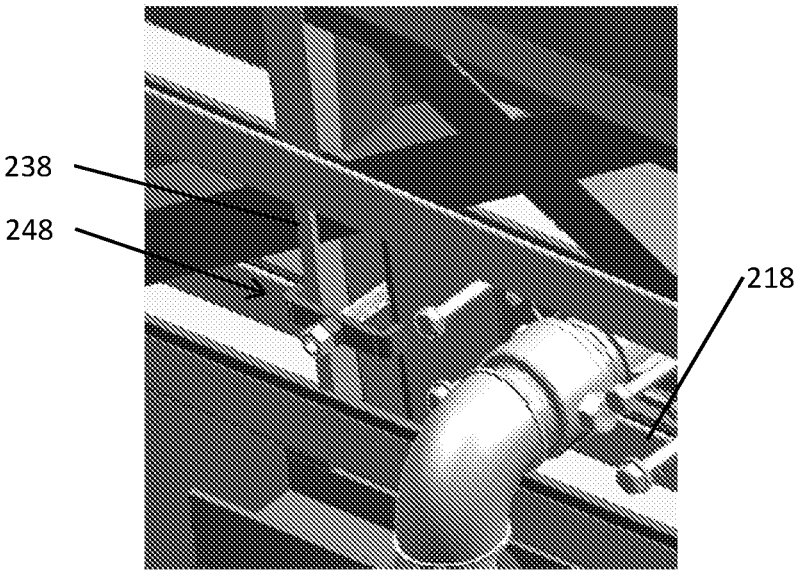
FIG. 35 is a bottom perspective view of the clamp of FIG. 32 installed.
Figure 36:
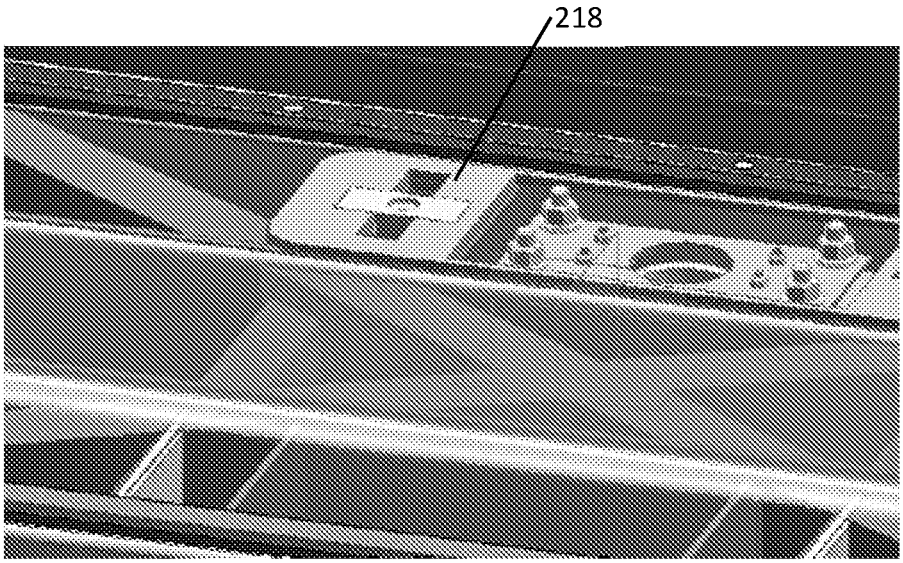
FIG. 36 is a top perspective view of the manifold with clamp installed of FIG. 35.
Figure 37:
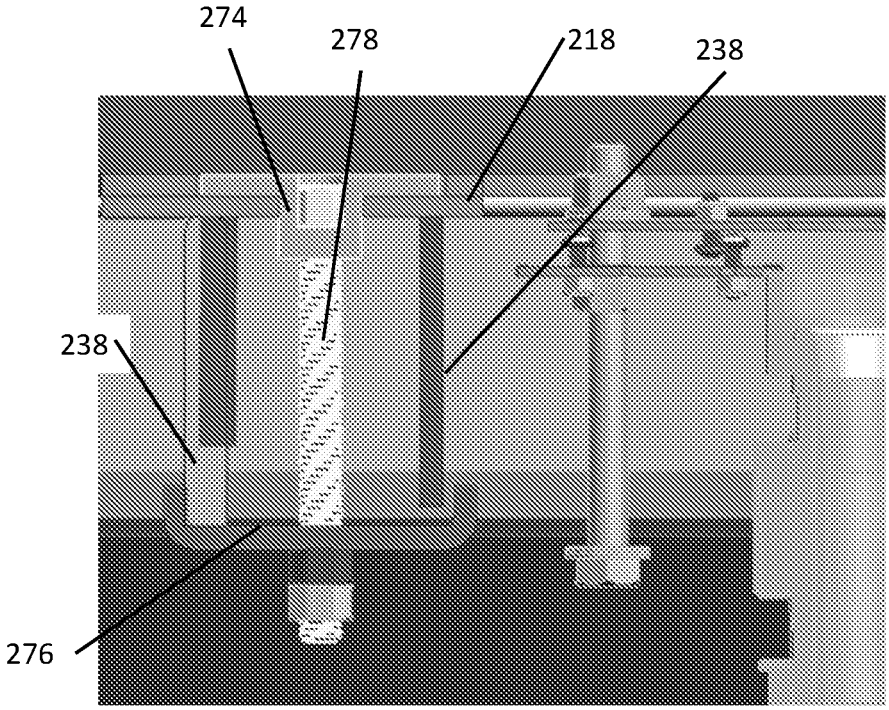
FIG. 37 is a cross-sectional view of the manifold with the clamp installed of FIG. 35.
Figure 38:
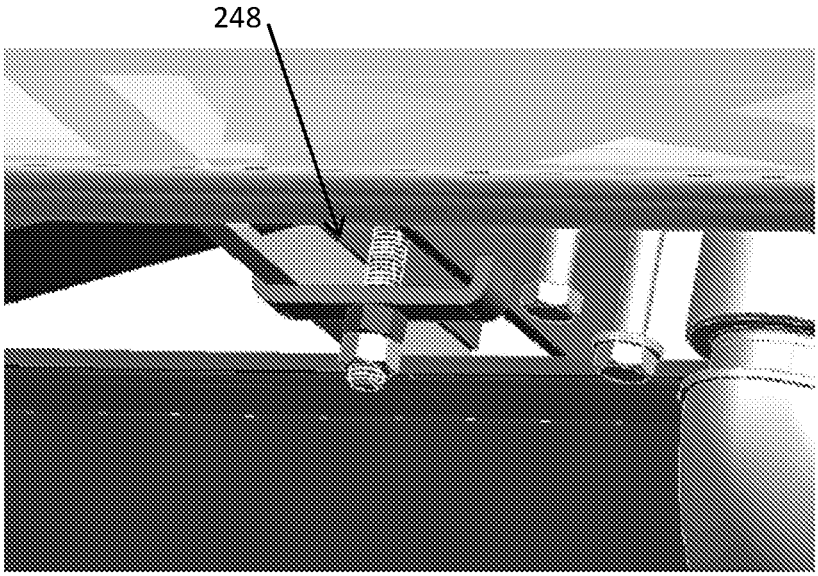
FIG. 38 is a bottom side perspective view of the clamp installed in the manifold of FIG. 35.

FIGS. 31-38 show another example of a pressure differential system with a manifold 218 secured to support structure 238 of a basket (not shown) of a vibratory separator (not shown). In this embodiment the manifold 218 is similar to that described above with reference to FIGS. 2-30 and is installed in the basket (not shown) such that the manifold 218 is disposed on and between two or more cross members of the support structure 238. However, in this embodiment, the manifold 218 is secured to the support structure 238 with a clamping device 248 inserted into the basket from a top side of the manifold 218. As shown in FIG. 33, the clamping device 248 includes a clamping block 274 and a clamp 276 coupled together with a bolt 278, for example, a socket head cap screw (SHCS) and jam nuts or weldnuts 280 (or other mechanical fastener, such as threaded rods or studs). The clamping block 274 may be rectangular in shape and the clamp 276 may have a c-shape profile such that the c-shape opens toward the clamping block 274. For example, as shown, the clamp 276 includes a first portion 282, a second portion 283 extending from a first end of the first portion 282 at a first angle, and a third portion 284 extending from a second end of the first portion at a second angle. The first and second angle may be approximately 90 degrees in some embodiments.

Figure 31:
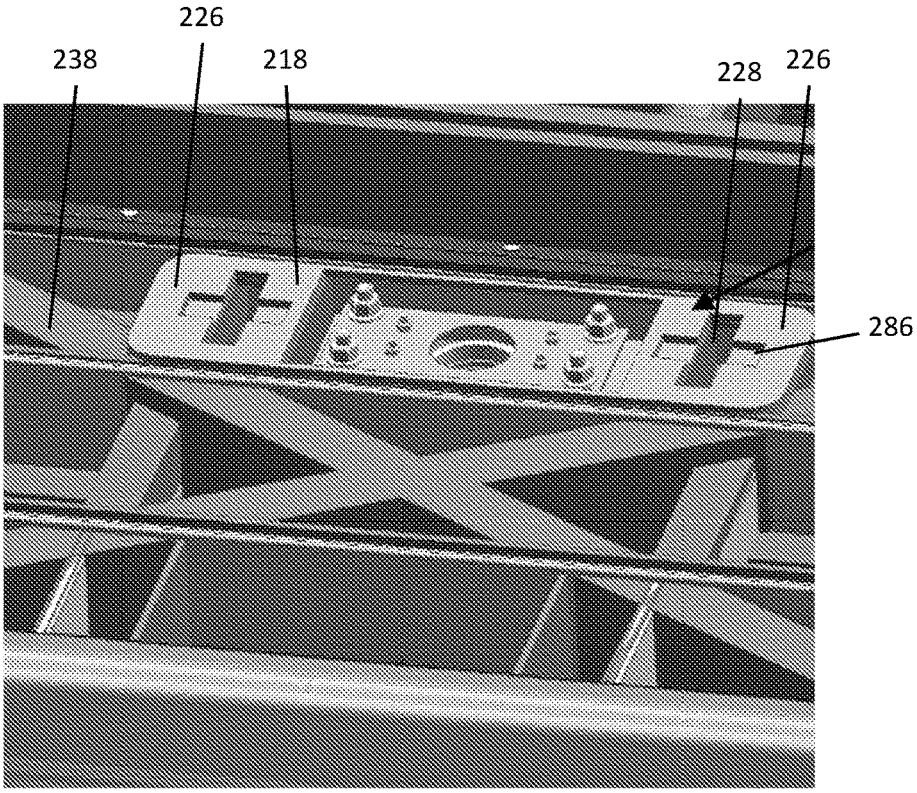
FIG. 31 is a perspective view of a manifold disposed in a basket of a vibrator in accordance with embodiments disclosed herein.
Figure 32:
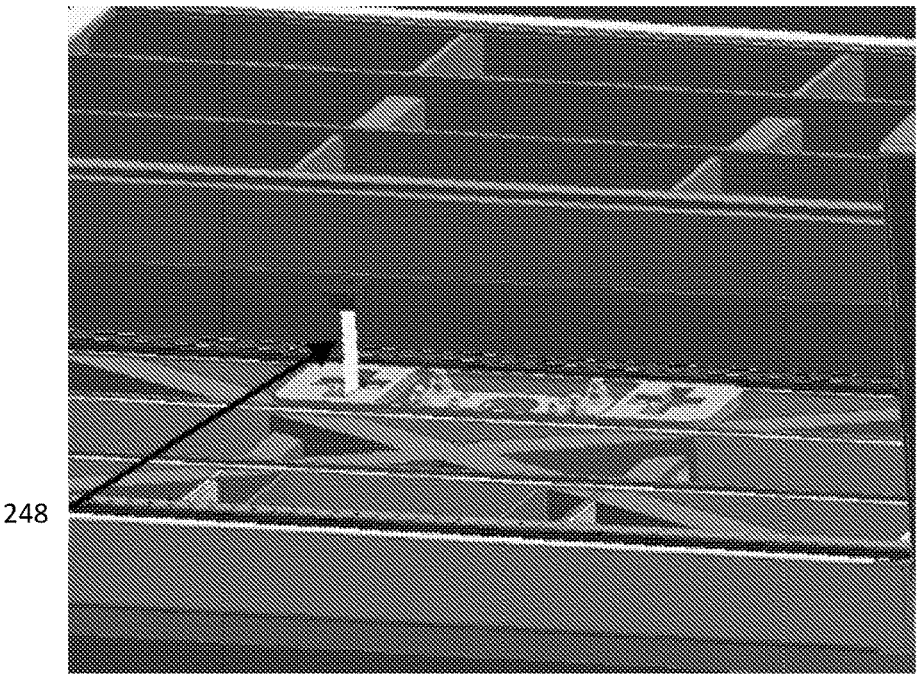
FIG. 32 is perspective view of the manifold of FIG. 31 during installation of the manifold into a basket using clamps in accordance with embodiments disclosed herein.

Openings 228 on the end regions 226 of the manifold 218 may include a profile similar to the profile of the clamps 276 to allow the clamps 276 of the clamping device 248 to be inserted through the manifold 218. Further, a recess 286 having a profile similar to the clamping block 274 may be formed in a top surface of end regions 226 the manifold 218, the orientation of the recess 286 being rotationally offset from the orientation of the openings 228, as shown in FIG. 31. Once the clamp 276 is inserted through the opening 228 of the manifold 218 and lowered, the SHCS 278 is rotated allowing the clamp 276 to clamp onto the support structure 238, for example, basket web bars. The manifold 218 may then be lifted slightly to fully engage the clamp 276 against the support structure 238. The SHCS 278 is then tightened, pulling the manifold down onto the basket, and moving the clamping blocks 274 into the recesses 286 of the manifold 218. Once the manifold 218 is clamped into place in the basket (not shown), a pan (not shown) may be coupled to the manifold 218 and a screen (not shown) installed on the pan, as described above with respect to FIGS. 4-30.

Figure 39:
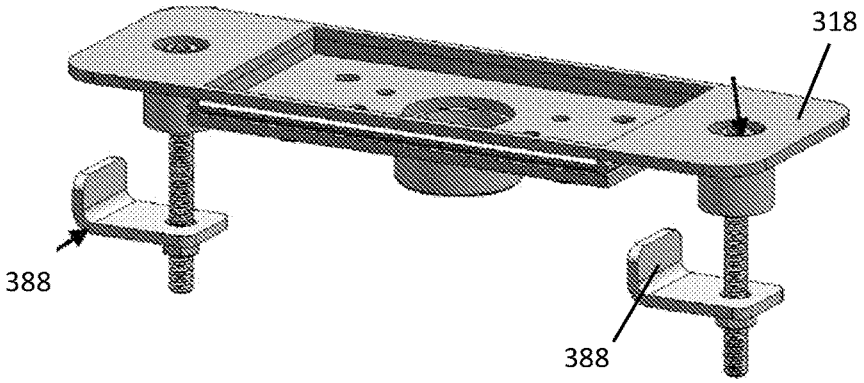
FIG. 39 is a perspective view of a manifold and clamping device in accordance with embodiments disclosed herein.
Figure 40:
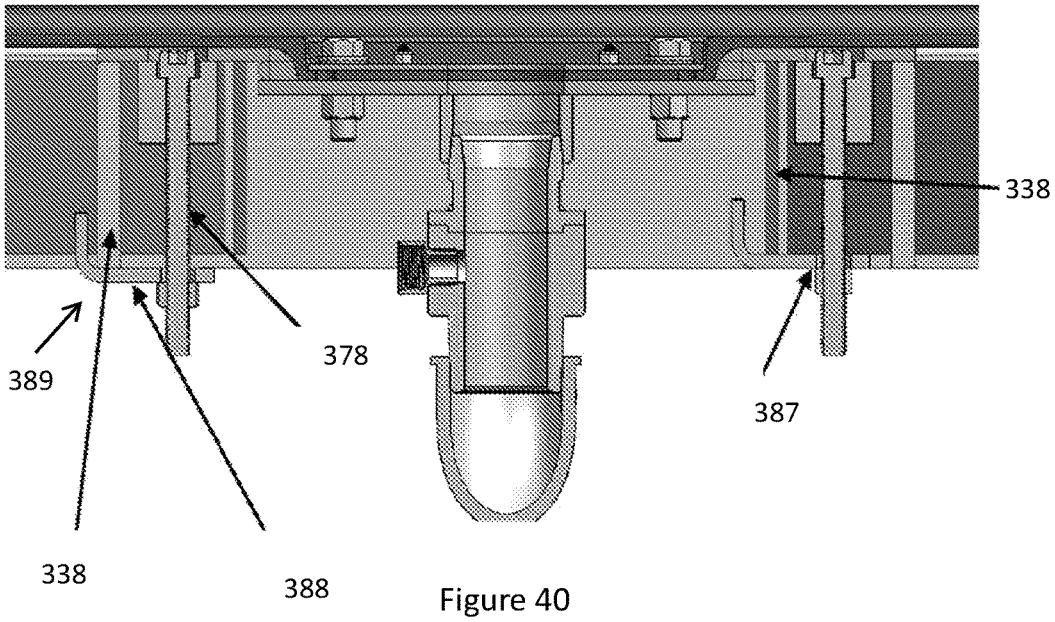
FIG. 40 is a cross-sectional view of the manifold of FIG. 39 coupled to support structure of a vibratory separator in accordance with embodiments disclosed herein.

FIGS. 39 and 40 show another embodiment of a manifold 318 that may be used with a pressure differential system in accordance with embodiments disclosed herein. Manifold 318 includes features similar to that described above, however in this embodiment, manifold 318 is secured to support structure 338 using bolts 378 (or other mechanical fastener, such as threaded rods or studs) and angle brackets 388. The angle bracket may be oriented such that a first portion of the angle bracket that is angled vertically upward toward the manifold 318 may be positioned laterally inward of the bolts 378 as shown at 387 or laterally outward of the bolts 378 as shown at 389 depending on location or positioning of the manifold 318 with respect to the support structure 338. The angle brackets may be tightened against the bottom of the support structure 338 by tightening the bolts 378 from the top.

Figure 41:
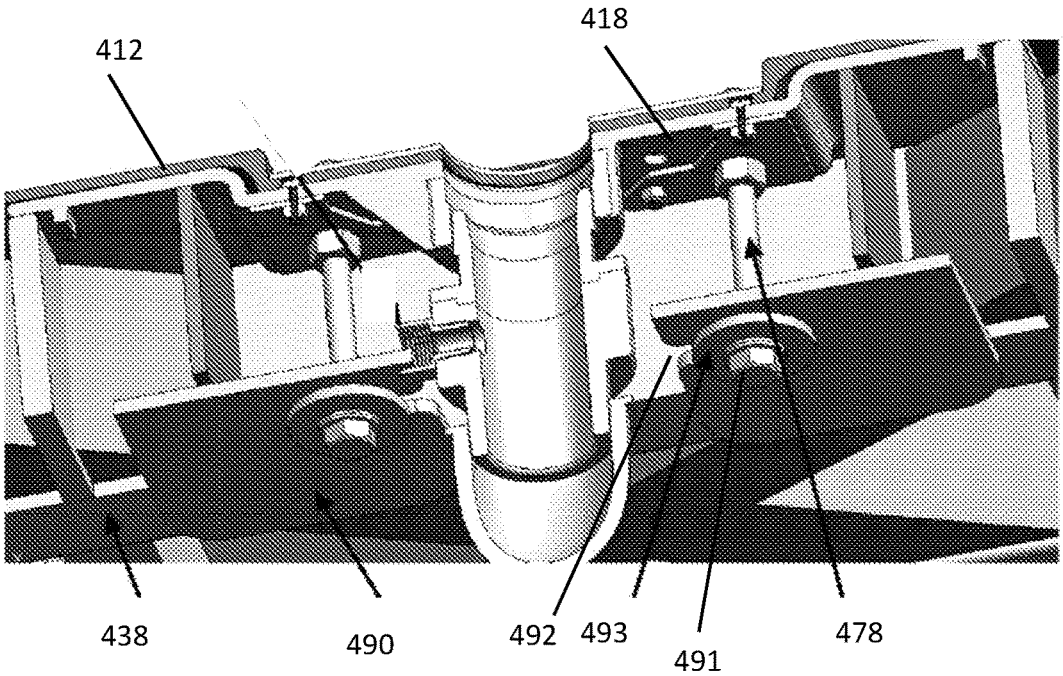
FIG. 41 is a bottom perspective view of a manifold coupled to a support structure of a vibratory separator with a slide plate in accordance with embodiments disclosed herein.
Figure 42:
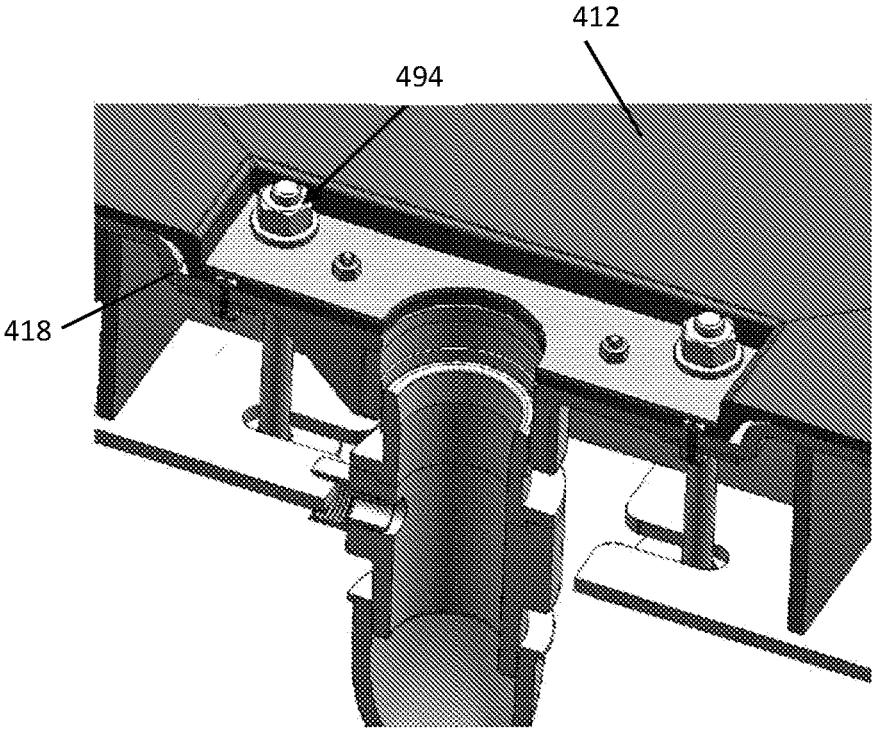
FIG. 42 is a top perspective view of the manifold coupled to the support structure of FIG. 41.

FIGS. 41 and 42 show another embodiment of a manifold 418 coupled to support structure 438 of a basket (not shown) of a vibratory separator (not shown) that may be used with a pressure differential system in accordance with embodiments disclosed herein. The manifold 418 includes features similar to that described above, however in this embodiment, manifold 418 is secured to the support structure 438 using a slide plate 490. In this embodiment, bolts 478 (or other mechanical fastener, such as threaded rods or studs) are installed through the manifold 418 and a nut 491 is tightened on a lower end of each bolt 478 to a first location. The slide plate 490 includes at least one opening 492 in a central portion thereof configured to receive the bolts 478. The slide plate is then slid onto the bolts 478 with a washer 493 disposed between the slide plate 490 and nut 491. The bolts are then tightened from the lower end to a second location where a top surface of the slide plate 490 contacts a bottom surface of the support structure 438, thereby clamping the manifold 418 to the support structure 438. In this embodiment, the bolts 478 and additional nuts 494 may be used to secure the pan 412 to the manifold 418, as shown in FIG. 42.

Figure 43:
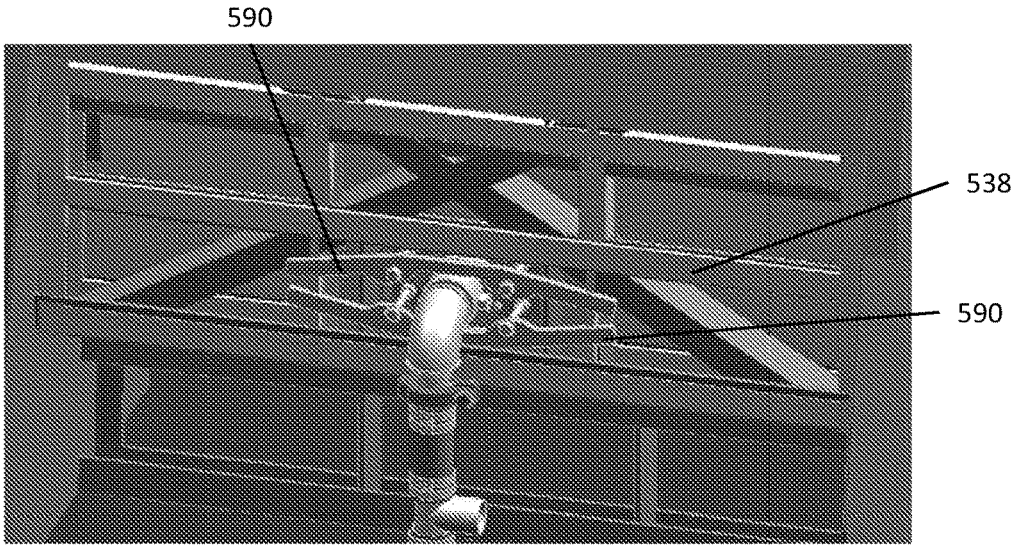
FIG. 43 is a bottom perspective view of a manifold coupled to a support structure of a vibratory separator with two slide plates in accordance with embodiments disclosed herein.
Figure 44:
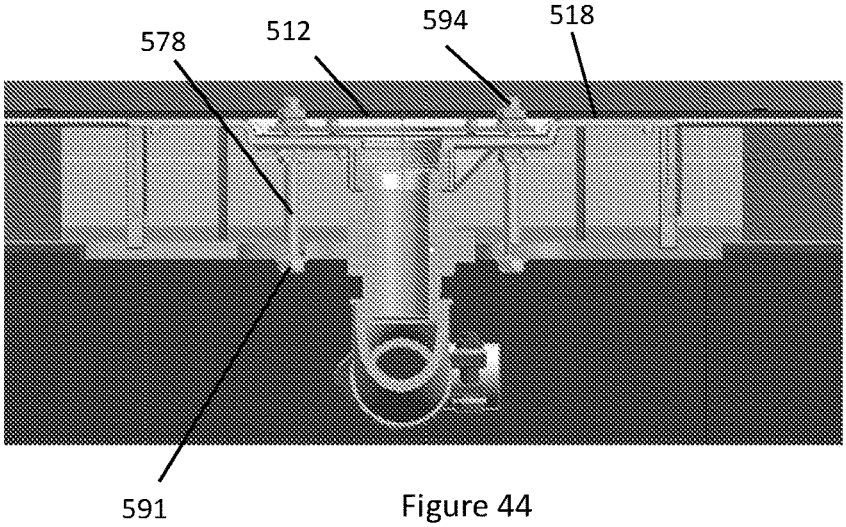
FIG. 44 is cross-sectional view of the manifold coupled to the support structure of FIG. 43.
Figure 45:
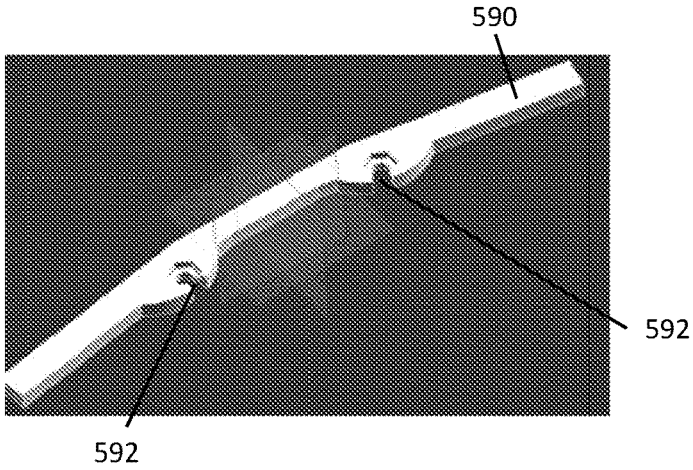
FIG. 45 is a perspective view of a slide plate of the embodiment shown in FIG. 43.

FIGS. 43-45 show another embodiment of a manifold 518 coupled to support structure 538 of a basket (not shown) of a vibratory separator (not shown) that may be used with a pressure differential system in accordance with embodiments disclosed herein. The manifold 518 includes features similar to that described above, however in this embodiment, manifold 518 is secured to the support structure 538 using two slide plates 590. In this embodiment, four bolts 578 (or other mechanical fastener, such as threaded rods or studs) are installed through the manifold 518 and a nut 591 is tightened on a lower end of each bolt 578 to a first location. The slide plates 590 each include two openings 592, each opening configured to receive one bolt 578. The slide plates 590 are then slid onto the bolts 578. The bolts 578 are then tightened from the lower end to a second location where a top surface of the slide plates 590 contacts a bottom surface of the support structure 538, thereby clamping the manifold 518 to the support structure 538. In this embodiment, the bolts 578 and additional nuts 594 may be used to secure the pan 512 to the manifold 518, as shown in FIG. 44.

Figure 46:
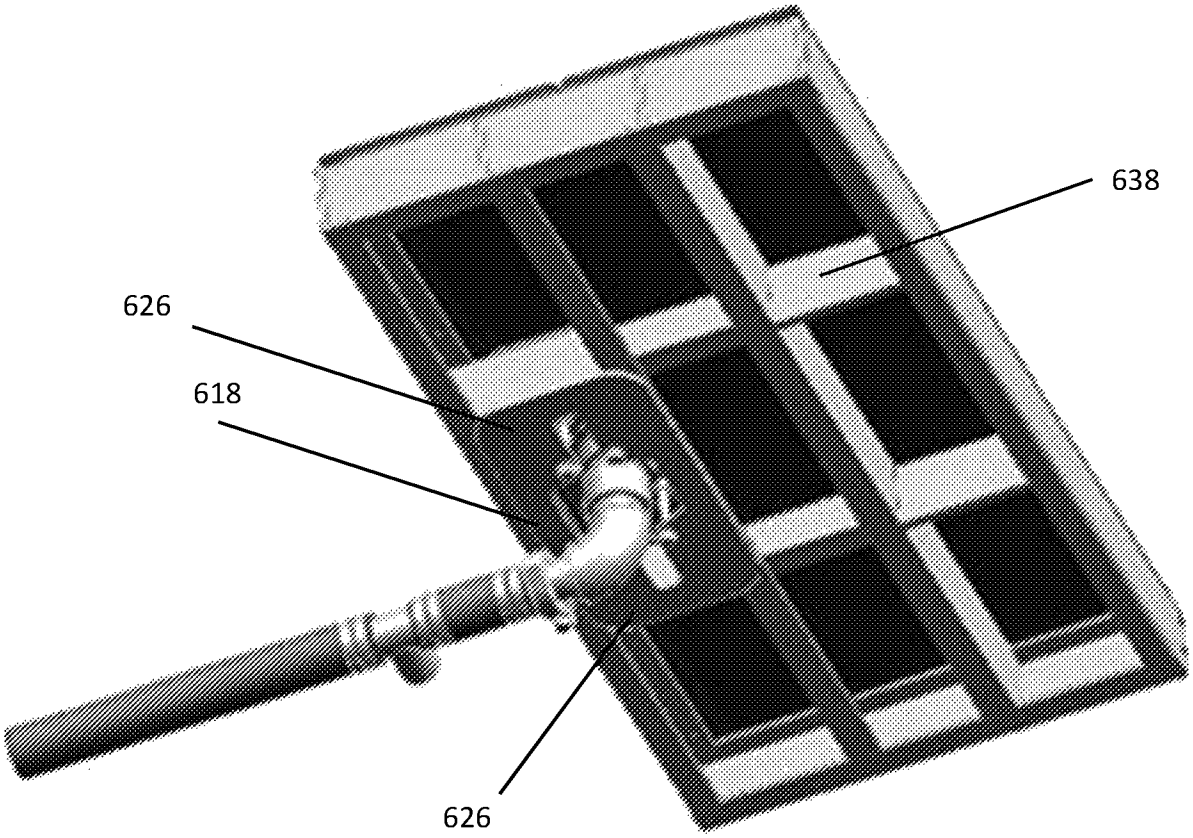
FIG. 46 is a bottom perspective view of a manifold coupled to support structure of a vibratory separator in accordance with embodiments disclosed herein.

FIG. 46 shows another embodiment of a manifold 618 coupled to support structure 638 of a basket (not shown) of a vibratory separator (not shown) that may be used with a pressure differential system in accordance with embodiments disclosed herein. The manifold includes feature similar to that described above, however in this embodiment, the manifold 618 is a plate-like structure that is mechanically fastened to a bottom surface of support structure 638. For example, the manifold 618 may include two end regions 626, each of which is bolted to a bottom surface of a member of the support structure 638.

Although the preceding description has been described herein with reference to particular means, materials and embodiments, it is not intended to be limited to the particulars disclosed herein. Rather, it extends to all functionally equivalent structures, methods and uses, such as are within the scope of the appended claims.

What is claimed:

1. An apparatus comprising:

a vibratory separator including a basket having support structure therein;

a manifold coupled to the support structure with a clamping device;

a pan disposed above the manifold and coupled to the manifold;

a screen disposed on the pan; and a pressure differential device coupled to the manifold and configured to provide a pressure differential across the screen, wherein the manifold comprises a plate having a recessed region between two end regions, and wherein the two end region are disposed on two members of the support structure and the recessed region is disposed between the two members of the support structure.

2. The apparatus of claim 1, wherein the clamping device comprises two clamping blocks, each one of the two clamping blocks coupled to an end region of the manifold with a mechanical fastener.

3. The apparatus of claim 2, wherein each one of the two clamping blocks comprises a first portion and a second portion, the first portion having a groove opening toward a top side of the first clamping block and the second portion having a bore extending from the top side of the first clamping block.

4. The apparatus of claim 3, wherein the groove of each of the two clamping blocks is configured to receive and engage a bottom surface of a member of the support structure.

5. The apparatus of claim 2, wherein the manifold includes an opening in the end region configured to engage the mechanical fastener.

6. The apparatus of claim 2, wherein the pressure differential device is coupled to the manifold by a flowline.

7. The apparatus of claim 2, wherein the manifold includes an opening aligned with a corresponding opening of the pan through which the pressure differential is applied to the screen.

8. A method comprising:

coupling a manifold to a support structure of a vibratory separator;

disposing a pan on the support structure and the manifold and coupling the pan to the manifold;

disposing a screen on the pan; and connecting the manifold to a pressure differential device for providing a pressure differential across the screen, wherein coupling the pan to the manifold comprises bolting the pan to the manifold in a recessed region of the manifold and a corresponding recessed region of the pan proximate aligned openings in the manifold and pan through which the pressure differential is provided.

9. The method of claim 8, wherein the coupling the manifold to a support structure comprises: engaging a clamping device with the manifold and a bottom surface of the support structure; and tightening the clamping device.

10. The method of claim 9, wherein the coupling the manifold to a support structure further comprises: engaging a groove formed in a clamping block of the clamping device with the bottom surface of the support structure; and tightening a bolt extending between the manifold and the clamping block.

11. An apparatus comprising:

a vibratory separator including a basket having support structure therein;

a manifold coupled to the support structure with a clamping device;

a pan disposed above the manifold and coupled to the manifold;

a screen disposed on the pan; and a pressure differential device coupled to the manifold and configured to provide a pressure differential across the screen, wherein the pan includes a recessed region corresponding to a recessed region of the manifold.

* * * * *